US010882171B2

(12) United States Patent
Vettoretti et al.

(10) Patent No.: US 10,882,171 B2
(45) Date of Patent: Jan. 5, 2021

(54) GAS FIXING TOOL

(71) Applicant: Illinois Tool Works Inc., Glenview, IL (US)

(72) Inventors: Alain Vettoretti, Bourg les Valence (FR); Patrick Herelier, Saint Jean de Muzols (FR); Frédéric Nayrac, Bourg les Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 500 days.

(21) Appl. No.: 15/409,141

(22) Filed: Jan. 18, 2017

(65) Prior Publication Data

US 2017/0203424 A1 Jul. 20, 2017

(30) Foreign Application Priority Data

Jan. 20, 2016 (FR) ..... 16 50433

(51) Int. Cl.
*B25C 1/00* (2006.01)
*B25C 1/08* (2006.01)
*B25C 1/14* (2006.01)

(52) U.S. Cl.
CPC ..... *B25C 1/008* (2013.01); *B25C 1/08* (2013.01); *B25C 1/143* (2013.01)

(58) Field of Classification Search
CPC ..... B25C 1/008; B25C 1/08; B25C 1/143; B25C 1/04; B25C 1/043; B25C 1/046; B25C 1/047
USPC ..... 227/8, 9–11, 130
See application file for complete search history.

(56) References Cited

U.S. PATENT DOCUMENTS 4,483,474 A * 11/1984 Nikolich ..... B25C 1/008 123/46 SC
5,197,646 A 3/1993 Nikolich
5,522,532 A * 6/1996 Chen ..... B25C 1/008 227/130
5,797,538 A * 8/1998 Heaton ..... A61B 17/07207 227/176.1

(Continued)

FOREIGN PATENT DOCUMENTS

EP 0 123 717 11/1984
EP 1 243 383 9/2002

(Continued)

OTHER PUBLICATIONS

New Zealand First Examination Report for New Zealand Application No. 727867, dated May 30, 2017 (4 pages).

(Continued)

*Primary Examiner* — Thomas M Wittenschlaeger
(74) *Attorney, Agent, or Firm* — Neal, Gerber & Eisenberg LLP

(57) ABSTRACT

Gas fixing tool, including at least one combustion chamber, a trigger, a device for injecting fuel into the at least one chamber, a member for actuating the device, and a bearing member intended to be brought to bear on a support material, characterized in that it further comprises a safety member configured to cooperate on the one hand with the actuating member and on the other hand with the trigger, so that the trigger is locked in its first position when the actuating member is in a first position.

22 Claims, 12 Drawing Sheets

(56) References Cited

U.S. PATENT DOCUMENTS

| | | | | |
|---|---|---|---|---|
| 6,526,926 | B1 * | 3/2003 | Towfighi | B25C 1/08 123/46 R |
| 6,715,655 | B1 * | 4/2004 | Taylor | B25C 1/08 227/10 |
| 2005/0184120 | A1 * | 8/2005 | Terrell | B25C 1/008 227/8 |
| 2005/0205638 | A1 * | 9/2005 | Wang | B25C 1/04 227/8 |
| 2006/0144379 | A1 * | 7/2006 | Wang | B25C 1/043 124/3 |
| 2006/0186166 | A1 | 8/2006 | Akiba | |
| 2006/0213945 | A1 * | 9/2006 | Ke | B25C 1/043 227/8 |
| 2007/0170222 | A1 * | 7/2007 | Bromley | B25C 1/04 227/8 |
| 2008/0185416 | A1 * | 8/2008 | Deng | B25C 1/04 227/8 |
| 2013/0334275 | A1 * | 12/2013 | Lam | B25C 5/13 227/8 |
| 2015/0170848 | A1 | 6/2015 | Kannan et al. | |
| 2017/0001291 | A1 * | 1/2017 | Schnell | B25C 1/00 |

FOREIGN PATENT DOCUMENTS

| | | |
|---|---|---|
| EP | 2 087 220 | 10/2011 |
| EP | 2 428 320 | 3/2013 |
| FR | 2 875 160 | 3/2006 |
| JP | 2008-260094 | 10/2008 |
| WO | WO 2015/053873 | 4/2015 |

OTHER PUBLICATIONS

New Zealand Further Examination Report for New Zealand Application No. 727867, dated Dec. 7, 2017 (4 pages).
Australian Examination Report No. 1 for Australian Application No. 2016277633, dated Jul. 7, 2017 (6 pages).
Australian Examination Report No. 2 for Australian Application No. 2016277633, dated Apr. 11, 2018 (3 pages).

* cited by examiner

GAS FIXING TOOL

PRIORITY CLAIM

This patent application claims priority to and the benefit of French Patent Application No. 1650433, which was filed on Jan. 20, 2016, the entire contents of which are incorporated herein by reference.

FIELD

The present disclosure relates to a gas fixing tool.

BACKGROUND

So-called gas sealing or fixing tools comprise an internal combustion engine operated by igniting an air-fuel mixture in a combustion chamber. An injection device injects the fuel (which can be made of gasoline, alcohol, and the like in liquid and/or gaseous form) into the chamber from a fuel cartridge. These tools are configured to drive fixing elements (such as hooks, nails, points, staples, or pins) into support materials (such as wood, concrete, or steel) to attach parts there.

In general, such a tool is portable and comprises a housing in which the internal combustion engine is mounted, propelling a piston that drives a fixing element. Such a tool can also comprise an electric power supply battery and a handle for grasping, holding, and firing, and on which a trigger is mounted.

A firing cycle comprises several steps such as the distribution of a quantity of fuel by the cartridge, the admission of the fuel into the chamber, the mixing of the fuel with the air in the chamber, the ignition and the combustion of the air-fuel mixture for the driving of the piston, and the evacuation of the combustion gases from the chamber.

A combustion chamber comprises a gas admission valve. This valve comprises a body that is movable between a first closing position and a second opening position of a gas admission orifice.

The first steps of a firing cycle are brought about by bearing the tool against the support material in which a fixing element is going to be anchored. This bearing causes fuel to be injected into the combustion chamber via the admission valve. The user of the tool must then manually depress the trigger of the tool to close the admission chamber and produce a spark in the chamber, resulting in an igniting of the air-fuel mixture in the chamber.

Ideally, the igniting of this mixture should occur in a very definite period of time. If the ignition occurs too early because the user has depressed the trigger too soon (while bearing the tool against the support material, for example), the air-fuel mixture might not be optimal and a poor combustion of this mixture might occur in the chamber. If the ignition occurs too late because the user has depressed the trigger too late (several seconds after bearing the tool against the support material), the air-fuel mixture injected into the chamber might be partly evacuated into the atmosphere and thus not be sufficient in quantity for its ignition to occur.

The diffusion of the air-fuel mixture contained in the chamber into the atmosphere after a predetermined time from bearing the tool against the material (typically on the order of a few seconds) is necessary for reasons of safety. In particular, this avoids the risk of too large a quantity of fuel building up in the combustion chamber when the tool is placed against the support material on several occasions close together.

Thus, there is a need to guarantee that the ignition of the mixture in the chamber does not occur too soon during a firing cycle.

The present disclosure provides a simple, effective, and economical solution to this problem.

SUMMARY

The present disclosure concerns a gas fixing tool comprising:

at least one combustion chamber, a trigger configured to be moved manually from a first or rest position to a second or firing position, a device for injecting fuel into the at least one chamber, a member for actuating the device configured to be moved from a first or rest position to a second position for actuating the device and injecting fuel into the at least one chamber, and a bearing member intended to be brought to bear on a support material, the bearing member being configured to be moved by bearing on the support material from a first or rest position to a second position, the bearing member being further configured to cooperate with the actuating member so that the movement of the bearing member from its first position to its second position causes the actuating member to move from its first position to its second position, characterized in that the tool further comprises a safety member configured to cooperate on the one hand with the actuating member and on the other hand with the trigger, so that the trigger is locked in its first position when the actuating member is in its first position.

The present disclosure thus makes it possible to guarantee the locking of the trigger in its first position of rest as long as the actuating member has not reached its second position. It will thus be understood that the user cannot activate the trigger until the tool is placed against the support material, and will not be able to activate it when the actuating member is moving between its first and its second position. Only when the actuating member is in its second position can the trigger be activated, which makes sure that the air-fuel mixture injected into the chamber will be optimal for its ignition. This is made possible by the safety member that cooperates with the actuating member and the trigger.

The tool according to the present disclosure may comprise one or more of the following characteristics, taken in isolation from each other or in combination with each other:

the combustion chamber is a precombustion chamber and/or a combustion chamber, the safety member is configured to be moved from a first position in which the actuating member is in its first position and/or the trigger is in its first position to a second position in which the actuating member is in its second position and/or the trigger is in its second position, the actuating member is moreover configured to cooperate with the safety member so that the movement of the actuating member from its first position to its second position causes or enables the movement of the safety member from its first position to its second position, the safety member is configured to be moved from its first to its second position by the movement of the actuating member from its first to its second position or by the movement of the trigger from its first to its second position, the safety member is configured to cooperate by bearing or abutment engagement with the actuating member and/or the trigger, the safety member is articulated to the actuating member and/or the trigger, the safety member is movable in translation or pivotable between its first and its second position, the actuating member and/or the trigger is configured to be moved by pivoting between its first and its second position, the safety member is urged toward its second position by an elastic biasing device, the safety member or the trigger is configured to cooperate with a mechanism for igniting an air-fuel mixture in the chamber and/or closing the chamber, the safety member or the trigger cooperates by bearing engagement or meshing with the igniting and/or closing mechanism, the safety member cooperates through bearing engagement with a longitudinal element controlling the igniting and/or the closing, the trigger meshes directly or via a pinion with a rack controlling the igniting and/or the closing; the intermediate pinion can be a simple pinion, merely reversing the direction of rotation; it can also be composed of two pinions of different diameter or number of teeth, joined in rotation on a common axle; in this case, the gear ratio of the travel or the force can be manipulated, since the trigger and the rack mesh with pinions of different gearing.

the rack or the element is configured to be moved between a first and a second position and to entrain with it a mobile element of a valve for admitting fuel into the combustion chamber, the safety member has an elongate shape and extends longitudinally substantially between the actuating member and the trigger, and the element or the rack and the safety member are substantially perpendicular.

The present disclosure likewise concerns a gas fixing tool comprising:

at least one combustion chamber, a trigger configured to be moved manually from a first or rest position to a second or firing position, a device for injecting fuel, and a valve for the admission of an air-fuel mixture into the at least one chamber, the valve comprising a movable body between a first opening position of an admission orifice and a second closing position of the orifice, characterized in that the tool comprises a mechanism to control the movement of the movable body, the mechanism being configured to cooperate on the one hand with the trigger or a member connected to the trigger and on the other hand with the movable element, so that the movement of the trigger from its first position to its second position causes the movement of the movable body from its first to its second position.

The tool according to the present disclosure may comprise one or more of the following characteristics, taken in isolation from each other or in combination with each other:

the combustion chamber is a precombustion chamber and/or a combustion chamber, the trigger can move on the one hand between its first position and an intermediate position in which the mechanism remains in its first position, the movement of the trigger from its intermediate position to its second position causing the movement of the movable body from its first to its second position; thus, the movement of the movable body is only initiated after a first, so-called "free" or "dead" travel of the trigger; this makes it possible to delay the closing of the admission valve of the combustion chamber, or the ignition of the chamber, and thus ensure a sufficiently long period of time to enable an optimal air-fuel mixture, the mechanism comprises a longitudinal element whose first end cooperates with the movable body and whose second opposite end cooperates with the trigger or the member connected to the trigger, the tool furthermore comprises a box defining the at least one combustion chamber, the box comprising a sliding element for the longitudinal element, the box has an elongated shape and the guide element extend along a longitudinal axis of the box, defining a longitudinal throat or longitudinal guide ribs of the longitudinal element, the longitudinal element has its first end engaging with a cavity of the movable body, when the trigger is hinged to the member comprising a bearing component configured to cooperate with the second end of the longitudinal element; this makes it possible to provide for the aforementioned dead travel at the start of the movement of the trigger, the trigger is in its first position, the bearing component is at a distance from the second end of the longitudinal element, the trigger meshes directly or by way of a pinion with the longitudinal element, forming a rack, when the trigger is in its first position, gear teeth of the trigger are at a distance from complementary teeth of the pinion or the rack; this makes it possible to provide for the aforementioned dead travel at the start of the movement of the trigger, the control mechanism is biased by an elastic return device in its first position, the control mechanism is likewise configured to control an ignition of the mixture in the at least one chamber, the control mechanism comprises an actuation device for causing an ignition device to generate a spark in the at least one chamber.

BRIEF DESCRIPTION OF THE FIGURES

The present disclosure will be better understood, and other details, characteristics, and advantages of the present disclosure will appear more clearly upon reading the following description (which is a nonlimiting example) and making reference to the accompanying drawings.

DETAILED DESCRIPTION

Figure 1:
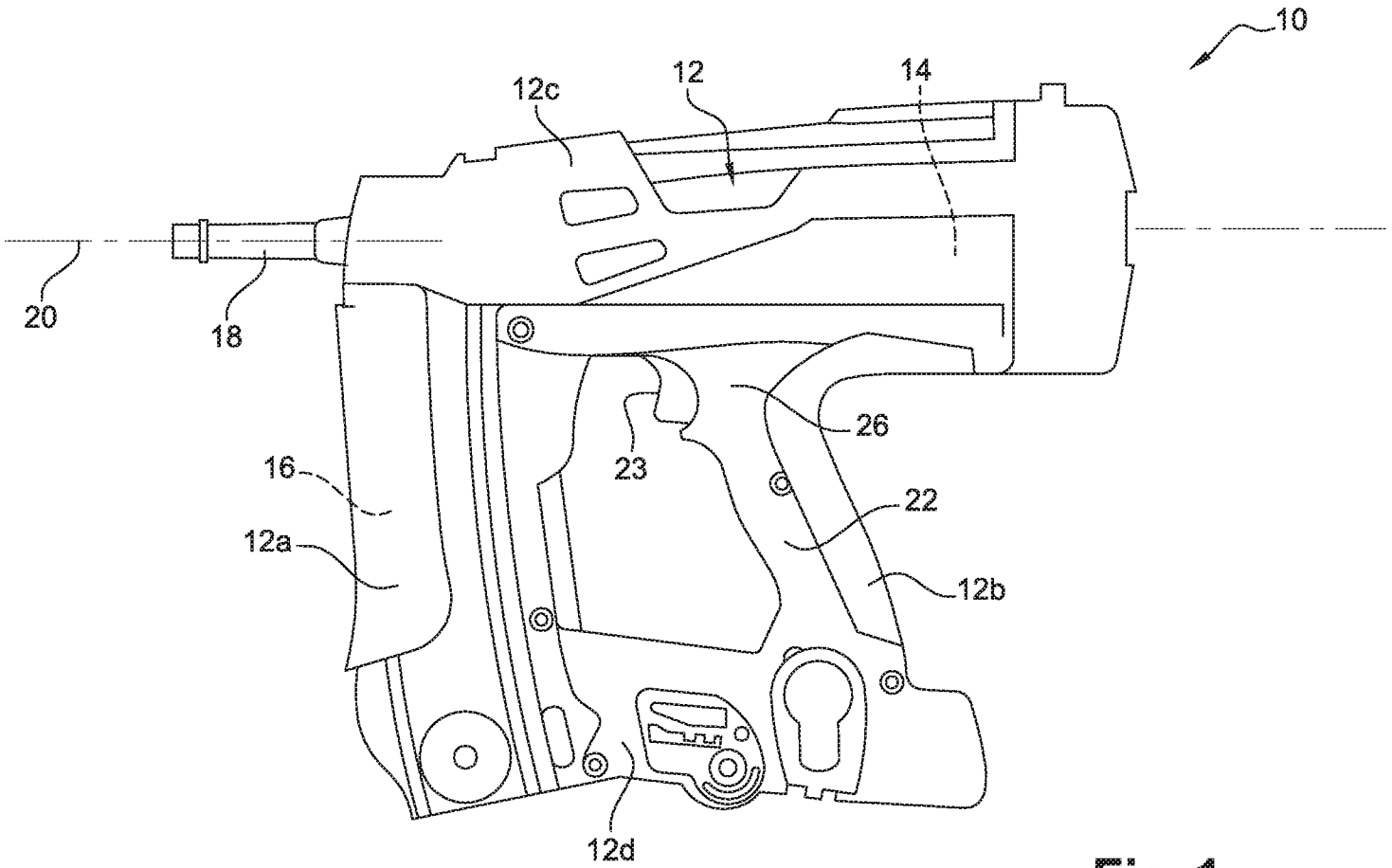
FIG. 1 is a schematic view of one embodiment of a gas fixing tool of the present disclosure.

The tool 10 represented in FIG. 1 comprises a housing 12 in which is found an internal combustion engine 14, with at least one combustion chamber configured to contain an air-fuel mixture, whose ignition causes the propelling of a piston configured to drive a fixing element, taken from a feeding magazine 16, the fixing element being configured to be anchored in a support material, upon exiting from a guide tip 18 extending in front of the housing 12.

The housing 12 of the tool has an axis 20 along which move the driving piston and, in the guide tip 18, the fixing elements.

The tool 10 comprises a handle 22 for grasping and manipulating the tool. This extends substantially perpendicular to the axis 20, being slightly slanted with respect to it depending on the application of the tool and the ergonomics during its use. The handle 22 likewise serves for firing by a trigger 23 mounted thereon.

The handle 22 defines a rear portion 12*b* of the housing 12 and the feeding magazine 16 is lodged in a front portion 12*a* of the housing, which extends substantially in parallel with the handle 22, that is, substantially perpendicular to the axis 20 or slightly slanted relative to this axis.

In the example shown, the housing 12 moreover comprises an upper portion 12*c* extending along the axis 20 and connecting the upper ends of the front 12*a* and rear 12*b* portions of the housing, and a lower portion 12*d* extending in parallel with the axis 20 and connecting the lower ends of the front 12*a* and rear 12*b* portions of the housing.

Figure 2:
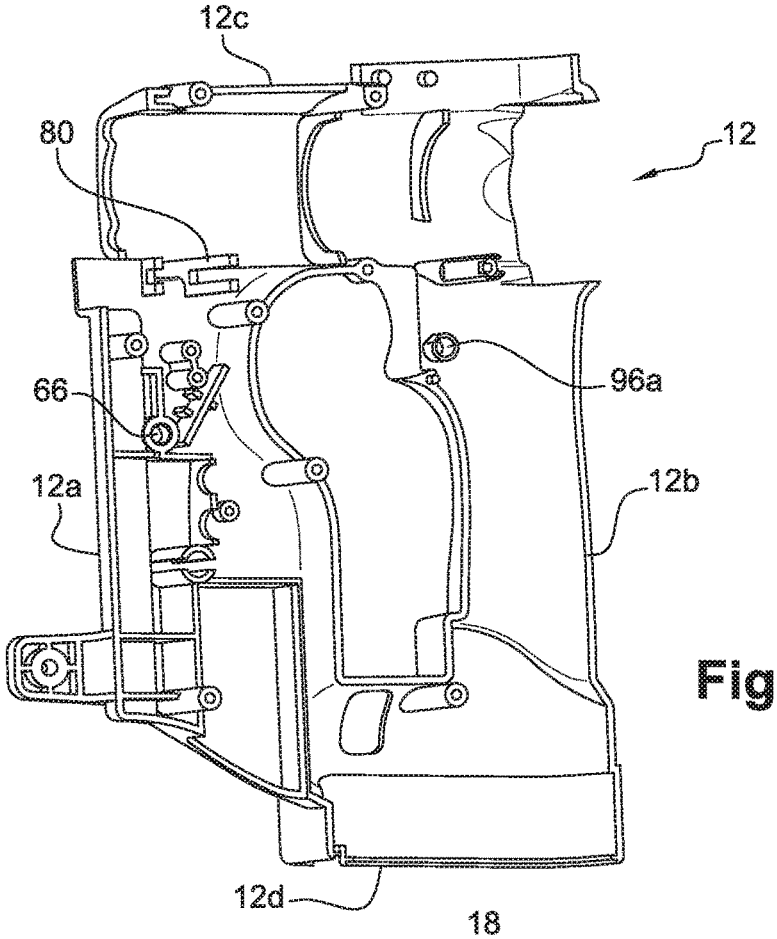
FIG. 2 is a schematic view of a portion of the housing of the tool of FIG. 1.

FIG. 2 represents a part of the housing 12 of the tool and more particularly one of the shells of this housing. The housing 12 is formed from at least two assembled shells, one of which can be seen in FIG. 2, and it defines one half of the rear portion 12*b* and thus of the handle 22 of the tool, one-half of the front portion 12*a*, and halves of the upper 12*c* and lower 12*d* portions of the housing.

Figure 3:
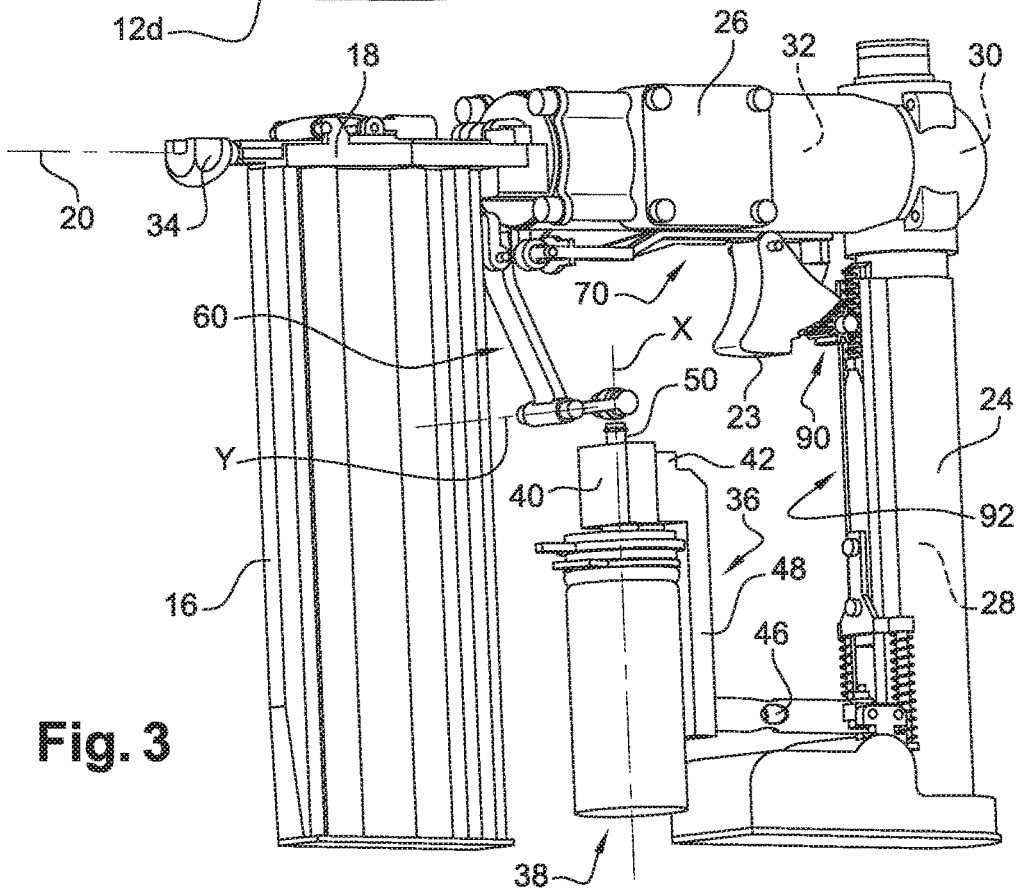
FIG. 3 is a schematic perspective view of internal elements of the tool of FIG. 1.

The shell comprises several seats and arrangements for mounting of internal elements of the tool, which can be seen in their mounting position in FIG. 3.

First of all, the feeding magazine 16 for feeding fixing elements, which is configured to be lodged in the front portion 12*a* of the housing 12, is shown. The boxes 24 and 26 defining the thermal engine, and more particularly a precombustion chamber 28, a combustion chamber 30, and a working chamber 32 in which the aforementioned piston is mounted in sliding manner, are also shown.

The box 24 defining the chamber 28 is configured to be lodged in the handle 22, that is, in the rear portion 12*b* of the housing. The box 26 defines the combustion chamber 30 and the working chamber 32 and it is configured to extend in the upper portion 12*c* of the housing. The magazine 16 and the box 24 are substantially parallel to each other and perpendicular to the box 26 that extends between the magazine 16 and the box 24.

The magazine 16 has an elongated shape and delivers the fixing elements by its upper longitudinal end, which is connected to the guide tip 18. The box 24 has an elongated shape, generally cylindrical, and it extends substantially the entire longitudinal dimension of the handle 22. Finally, the box 26 has an elongated shape and comprises a rear end defining the chamber 30 and connected to the upper end of the box 24 and a front end connected to the guide tip 18.

At the free end, here in front, of the guide tip 18 there is provided a bearing member 34 configured to bear against the support material. As will be explained in further detail in the following, this bearing action causes the distribution of a predetermined quantity of fuel to the precombustion chamber 28 and is thus necessary to produce a firing, that is, a projecting of a fixing element.

The feeding of fuel to the precombustion chamber 28 is done by way of an injection device 36 from a fuel gas cartridge 38.

The cartridge 38 and a part (front) of the injection device 36 are lodged in the front portion 12*a* of the housing 12, and the rest of the device 36 extends between the cartridge and the chamber 28 in the lower portion 12*d* of the housing.

The fuel is in the liquid state in the cartridge 38 and needs to be evaporated, the combustible gas being intended to be mixed with air before being burned in the chambers 28 and 30.

The injection device 36 of a gas fixing tool generally makes possible the evaporation of the fuel, its mixing with air, and the injection of this mixture into the chamber 28.

A valve 40 configured to calibrate a quantity of liquid fuel is interposed between the liquid fuel cartridge 38 and an evaporator unit 42. A filter can be arranged in a seat or bore provided in the unit 42. A predetermined quantity of liquid fuel is discharged from the cartridge 38 by way of the valve 40 in the unit 42, passing through the filter, and it arrives in an evaporation cavity. The unit 42 is made of thermally conductive material, such as a metal. The liquid fuel circulating through the filter is at least partly converted into gaseous fuel thanks to the input of heat from the surroundings, which transmit calories to the evaporator unit 42.

Downstream from the filter and the evaporation cavity, the fuel at least partly vaporized continues to circulate in the unit 42, and it absorbs additional heat from the surroundings. The downstream part of the unit 42 contains an evaporation line 48, acting as a distribution manifold, to the precombustion chamber 28 of the fixing tool.

The dimensional parameters of the device 36, and in particular of the evaporation cavity and the line 48, such as the length, the diameter, the thickness, etc., are configured so the fuel is entirely converted into gas upon exiting from a discharge orifice downstream from the line 48. To aid in the transfer of heat from the surroundings, the unit 42 and/or the line 48 can possibly have one or more fins disposed at least on one of their surfaces.

Emerging from the discharge orifice, the gaseous fuel can be directly injected into the precombustion chamber 28. As an option, the gaseous fuel leaving the discharge orifice can feed one or more nozzles for the exiting of the fuel and the feeding of the precombustion chamber 28. The fuel gas in one variant can feed a jet pump 46 of the venturi type, in which ambient air is entrained into the jet pump 46 and mixed with the gaseous fuel injected by the one or more nozzles, so as to form an air-fuel mixture for the feeding of the chamber 28.

The line 48 can be formed of a single piece with a part of the evaporator unit 42. The line 48 has a general S or L shape.

The evaporator unit 42 comprises a bore in which an actuating element 50 is mounted and able to slide along the longitudinal axis X of the cartridge 38. This actuating element 50 has an elongated rectilinear shape and comprises an internal bore, for example in the shape of a T or L. This bore comprises a first axial portion which extends along the element 50 and emerges at its lower end, and a radial portion which extends between the upper end of the axial portion and the periphery of the element. The mouth of this radial portion is situated opposite the aforementioned filter of the evaporator unit 42.

The element 50 is movable between two positions: a high or resting position represented in FIG. 3 and a low or working position. In the two cases, the aforementioned radial mouth of the bore is situated opposite the filter of the evaporator unit. Gaskets are provided between the element 50 and the bore in which it is mounted. The lower end of the element 50 is configured to cooperate with a connection port of the cartridge 38.

The movement of the element 50 from its resting position to its working position causes the release of a calibrated quantity of fuel from the cartridge 38. This fuel, in liquid form, circulates in the bore of the element 50 and crosses the filter of the evaporator unit 42, which holds back any impurities, before entering the evaporation cavity of the unit in which the transformation of the liquid fuel into gaseous fuel is initiated. The fuel circulates in the line 48 to complete its evaporation and arrives in the gaseous state in the area of the aforementioned nozzle. It is then atomized in the jet pump and mixed with air entering the pump by the venturi effect, the air-fuel mixture being then injected into the chamber 28 of the thermal engine.

Advantageously, and as represented in FIG. 3, the unit 42 is located above the cartridge, the line 48 extends in part on one side of the cartridge, and the jet pump 46 has an orientation basically perpendicular in relation to the longitudinal axis X of the cartridge or to the line 48. Ideally, the cartridge, the unit 42 and the line 48 are lodged in the forward arm and the jet pump 46 extends in the lower portion 12*d* of the housing.

As mentioned above, the thermal engine of the tool comprises a precombustion chamber 28, a combustion chamber 30, and a working chamber 32 in which the driving piston of a fixing element is able to move under the effect of the explosion of the air-fuel mixture in the combustion chamber 30.

The precombustion chamber 28 makes it possible to initiate the combustion of the air-fuel mixture. This chamber 28 comprises a cavity in which an ignition device such as a spark plug is installed.

Figure 9:
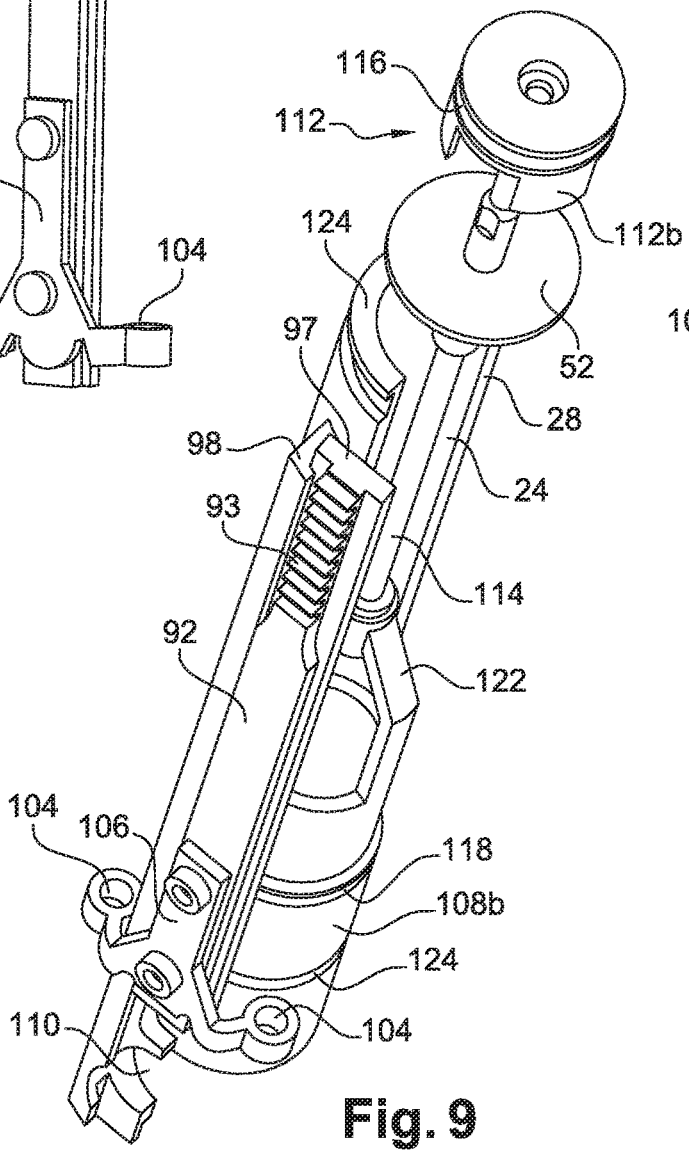
FIG. 9 is a schematic perspective view of a combustion chamber box on which is mounted the element of FIGS. 8*a* and 8*b*.
Figure 10:
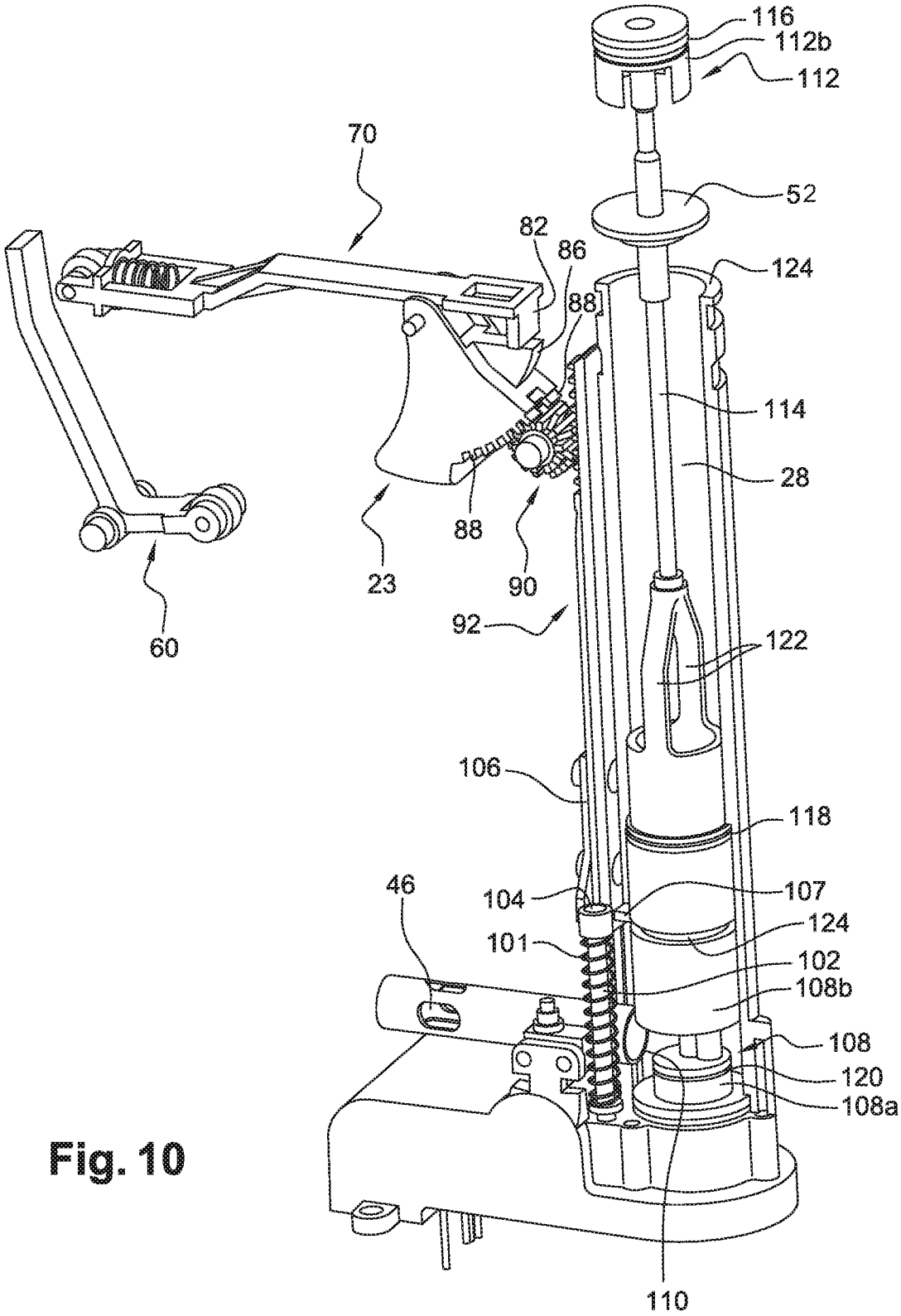
FIG. 10 is a schematic perspective view of internal elements of the tool of FIG. 1.

The chambers 28, 30 are separated from each other by a valve 52 visible in FIGS. 9 and 10. The precombustion of the mixture in the chamber 28 causes a rise in pressure in its cavity. When this pressure passes a certain threshold, the valve 52 opens and lets the fuel mixture pass into the chamber 30.

The mixture arrives in the chamber 30 with a relatively elevated pressure. The flame issuing from the chamber 28 reaches the chamber 30, the combustion at elevated pressure in the chamber 30 making it possible to improve the performance of the tool. The combustion in the chamber 30 produces a pressure rise in the chamber 30, which forces the piston to move into the working chamber 32.

Figure 4:
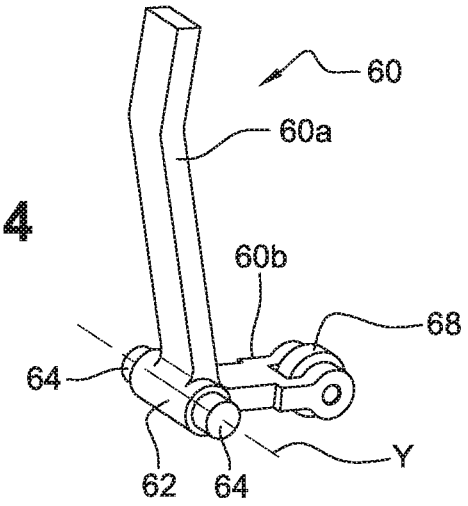
FIG. 4 is a schematic perspective view of an actuating member of the tool of FIG. 1.

FIG. 4 shows an actuating member 60 of the injection device 36. This member 60 is configured here to cooperate by bearing engagement with the actuating element 50 of the device 36.

In the example represented, the member 60 has a general L shape and comprises two arms 60*a* and 60*b* that are joined together. A first arm 60*a*, of greater length, has one free end and an opposite end connected to the second arm 60*b*, of shorter length. The ends of the arms 60*a*, 60*b* are joined together by a substantially cylindrical pin 62 defining a pivot axis Y for the member 60. The pivot Y axis is substantially perpendicular to a plane passing through the arms 60*a* and 60*b*. As can be seen in FIG. 3, the axis Y is perpendicular to the plane passing through the axes 20 and X.

The pin 62 has an elongated shape along the pivot axis Y and comprises a cylindrical peg 64 at each of its longitudinal ends. Each peg 64 is centered and guided in rotation in a complementary cylindrical seat 66 of a shell of the housing (FIG. 2). The member 60 is thus pivotably mounted directly in the housing 12 in this illustrated embodiment.

The free end of the arm 60*a* is configured to cooperate directly or by way of a suitable mechanism (such as a mechanical linkage) with the bearing member 34. The end of the arm 60*b* opposite the pin 62 is configured to cooperate by bearing engagement with the actuating element 50 of the device 36. This end of the arm is outfitted here with a roller 68 or a shoe, optionally mounted to rotate about an axis parallel to the pivot axis Y, at this end of the arm, and configured to cooperate by bearing engagement with the actuating element 50.

As is seen in particular in FIG. 3, the member 60 is mounted in the front portion of the housing, behind the magazine 16, between the injection device 30 and the box 26 or the working chamber 32.

Figure 11A:
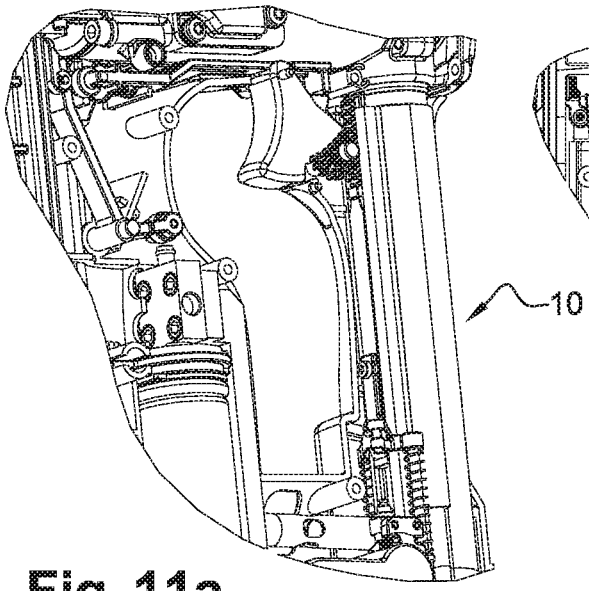
FIGS. 11*a*, 12*a*, 13*a*, and 14*a* are schematic perspective views of internal elements of the tool of FIG. 1, and FIGS. 11*b*, 12*b*, 13*b*, and 14*b* are schematic cross sectional views of these internal elements, showing the stages of operation of the tool of FIG. 1.
Figure 11B:
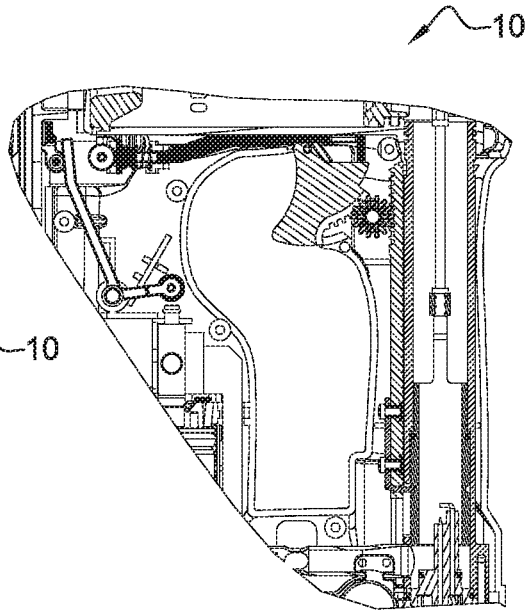

The member 60 is movable by pivoting between a first position of rest, represented in FIGS. 3, 11*a*, and 11*b* where the arms 60*a* and 60*b* extend respectively substantially at 11 o'clock and at 2 o'clock on the clock dial (the pivot axis Y of the member 60 representing the axis of rotation of the clock hands), and a second position represented in FIGS. 13*a* to 14*b* in which the arms extend respectively at 12 o'clock and 3 o'clock.

The pivoting of the member 60 here is brought about by the bearing of the tool 10, and more particularly its bearing member 34, against the support material. When the tool is not applied by way of its bearing member 34 against the support material, the member 60 is in its first position. The bearing of the tool against the support material causes the movement of the bearing member 34 with respect to the guide tip 18, which in turn causes the pivoting of the member 60 from its first to its second position.

The configuration of the member 60 and in particular the difference in length of the arms 60*a* and 60*b* makes it possible to exploit a leverage effect in the actuation of the device 36. That is, a mere bearing of the tool against the support material, the weight of the tool alone being enough to ensure the movement of the bearing member 34 from its first to its second position, is enough to actuate the distribution of fuel by the device 36 on account of the transmission of forces achieved by the member 60. The forces are transmitted by the end of the arm 60*b* or the roller to the actuating element 50 which is moved from its high position (FIGS. 3, 11*a*, and 11*b*) to its low position (FIGS. 12*a* to 14*b*).

Figure 5:
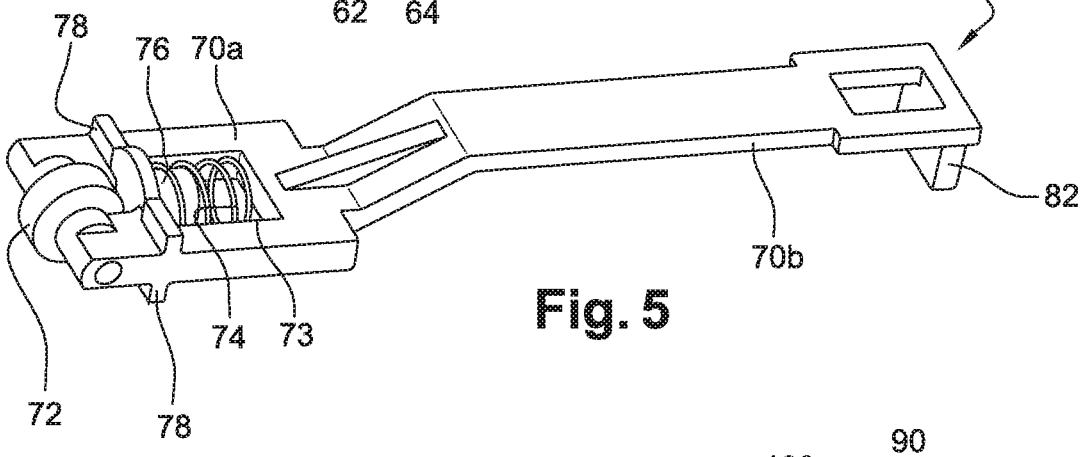
FIG. 5 is a schematic perspective view of a safety member of the tool of FIG. 1.

FIG. 5 shows a safety member 70 making it possible to lock the trigger 23 of the tool in a position of rest when the tool is not bearing against the support material. This member 70 is configured here to cooperate with the actuating member 60 on the one hand and the trigger 23 on the other hand.

In the example shown, the member 70 has an elongated shape extending substantially along the axis 20 of the tool. It is lodged here in the upper portion 12*c* of the housing, just below the box 26 and the working chamber 32.

The member 70 comprises a front foot 70*a* and a rear leg 70*b*. The front foot 70*a* is substantially planar. Its free front end is configured to cooperate by bearing engagement with the free end of the arm 60*a* of the member 60. This end is outfitted here with a roller 72 or a shoe, mounted optionally able to rotate about an axis parallel to the pivot axis Y, on this end of the arm, and configured to cooperate by bearing engagement with the member 60.

The foot 70*a* comprises a slot 73 substantially passing through its center (in a direction parallel to the axis X lying in the plane passing through the axes 20 and X) in which is lodged a return device such as a compression spring 74. The axis of the spring 74 is contained in the plane of the foot and is substantially parallel to the axis 20 and/or to the axis of extension of the member 70. The foot 70*a* comprises, inside the slot 73, a cylindrical peg 76 engaging with the spring 74 to maintain it and guide its compression. The compression spring 74 may be deformed in the slot 73 of the foot 70*a*. Finally, the foot 70*a* comprises, between the roller 72 and the spring 74, at the base of the peg 76, abutment components in the axial direction (along the axis of extension of the member 70) that are formed here by two transverse and coplanar ribs 78 situated respectively on the upper and lower faces of the foot 70*a*.

As can be seen in FIGS. 3 and 11*a* and the following, the front part of the foot 70*a* comprising the ribs 78 is configured to be located just behind the free end of the arm 60*a* of the member 60, and in front of the parallel branches of a U-shaped wall 80 of the shell of the housing 12, visible in FIG. 2. The foot 70*a*, and more particularly the part of the foot located behind the ribs 78, is mounted between these branches and can slide in a direction parallel to the axis 20 between these branches. The compression spring 74 bears by its free end opposite the peg 76 against the front faces of the branches, which can respectively comprise seats or arrangements to maintain or guide the spring during its compression.

The rear leg 70*b* of the member 70 has a substantially rectilinear shape and extends from the rear end of the foot 70*a*. The leg 70*b* comprises at its rear end a flange 82 oriented toward the bottom and configured to cooperate by bearing or abutment engagement with the trigger 23 for purposes of locking it in its position of rest.

The member 70 can move in translation between a first position of rest, represented in FIGS. 3 and 11*a* to 12*b*, in which the compression spring 74 holds the member 70 in this forward position, and a second position represented in FIGS. 13*a* to 14*b* in which the spring is compressed and the member 70 is in a retracted position.

Figure 12A:
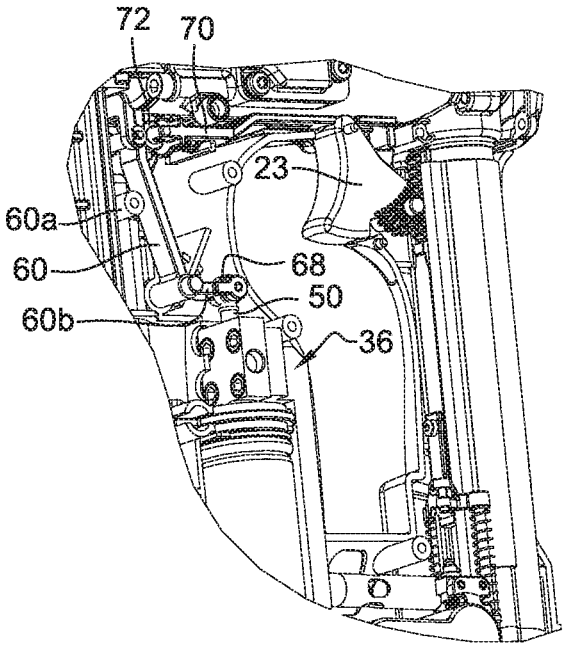
Figure 12B:
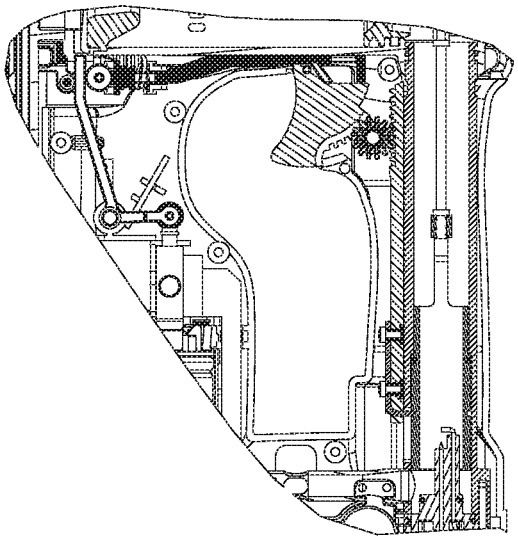

The movement of the member 70 here is caused by the bearing engagement of the tool, and more precisely by the pivoting of the member 60. When the member 60 is in its first position, the free end of its arm 60*a* is at a distance from the member 70 which remains in its front position of rest (FIGS. 11*a* and 11*b*). The bearing of the tool against the support material causes the pivoting of the member 60 from its first to its second position. During this pivoting, the member moves from its first position as represented in FIGS. 11*a* and 11*b* to an intermediate position as represented in FIGS. 12*a* and 12*b*, in which the free end of the arm 60*a* of the member 60 bears against (the roller of) the member 70, which remains in its first position of rest. The member 60 then moves from its intermediate position to its position as represented in FIGS. 13*a* to 14*b* in which the free end of the arm 60*a* of the member 60 bears against (the roller of) the member 70 which is moved in translation to its second position in which the compression spring 74 is constrained.

It is therefore seen that the translation, here toward the rear, of the member 70 will cause a movement toward the rear of the flange 82 locking the trigger 23.

Figure 6:
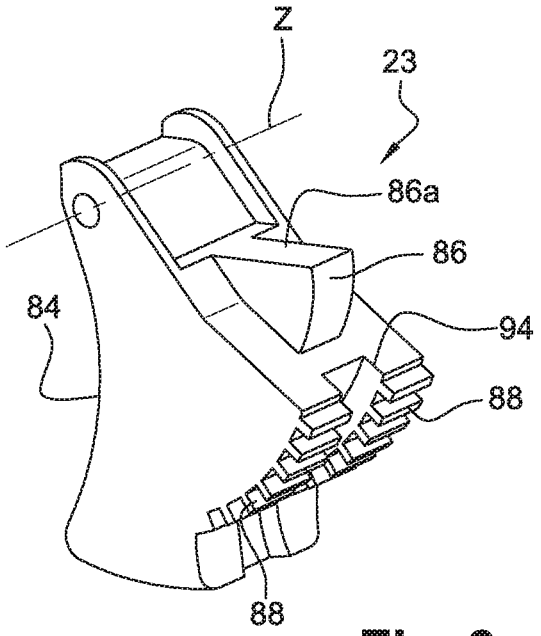
FIG. 6 is a schematic perspective view of a trigger of the tool of FIG. 1.

The trigger 23 of the tool is more visible in FIG. 6. The trigger 23 is mounted to pivot, here by its upper end, about an axis Z substantially perpendicular to the axis 20 and parallel to the axis Y. In typical manner, it comprises a surface 84, here in front, for the bearing against it of at least one finger of the user, such as the index finger.

The trigger 23 likewise comprises at its upper end an abutment component configured to cooperate with the flange 82 of the member 70. In the example shown, the trigger 23 comprises an upper lug 86 whose upper face 86*a*, here being planar, is configured to cooperate by bearing or abutment engagement, with the lower free end of the flange 82.

As can be seen in the drawings, when the members 60 and 70 are in their positions of rest (FIGS. 3, 11*a*, and 11*b*), the flange 82 is situated on the lug 86 or bears against the lug and locks the trigger 23 in its position of rest. If the user tries to operate the trigger 23, he will then feel a resistance corresponding to the bearing of the lug 86 against the flange 82, which can furthermore bear directly or by way of the rest of the member 70 against the box 26 or against a part of the housing 12. The user thus cannot operate the trigger 23. The pivoting of the member 60 from its position of rest to its intermediate position (FIGS. 12*a* and 12*b*) does not change anything about this situation, since the member 70 is still in its position of rest and locking of the trigger. The pivoting of the member 60 into its second position (FIGS. 13*a* and 13*b*) and the translation of the member 70 from its first to its second position is manifested by a movement to the rear of the flange 82 beyond the lug 86 of the trigger 23 and thus an unlocking of the trigger, which can then be moved by pivoting to its second position as represented in FIGS. 14*a* and 14*b*.

Figure 7:
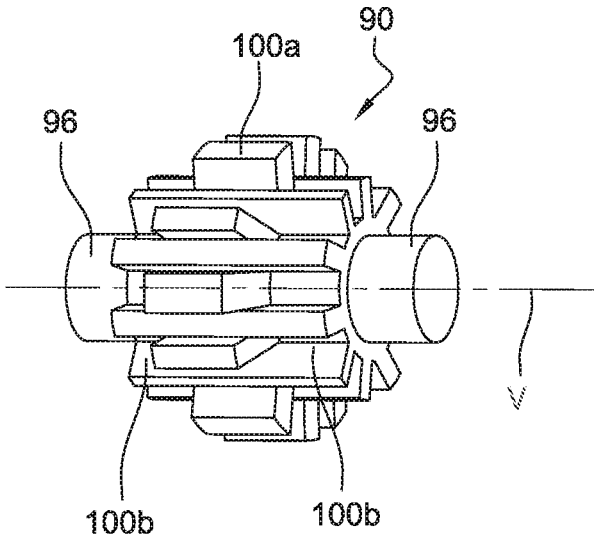
FIG. 7 is a schematic perspective view of a pinion of the tool of FIG. 1.
Figure 8A:
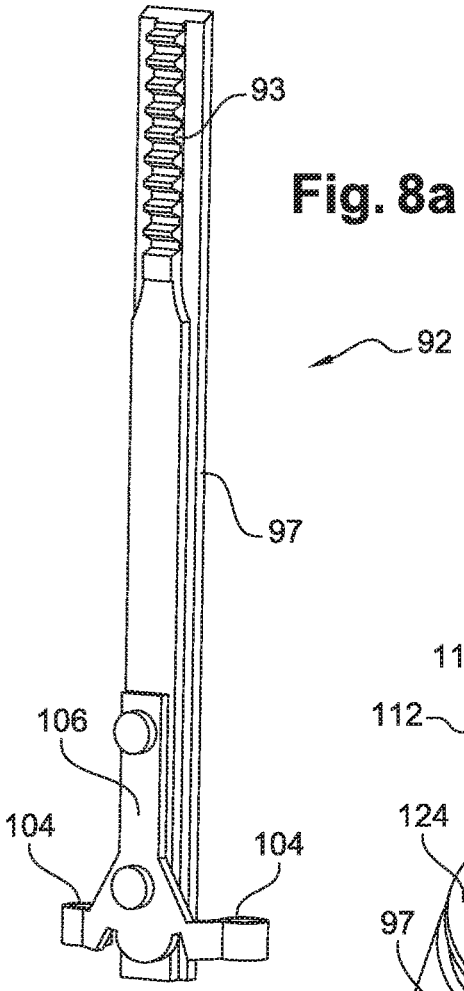
FIGS. 8*a* and 8*b* are schematic perspective views of a longitudinal control element of the tool of FIG. 1.

The trigger 23 comprises gear teeth 88 for engaging, here by way of a pinion 90 represented in FIG. 7, with a rack 92 (FIGS. 3 and 8*a* and the following).

The trigger 23 comprises two series of teeth 88 which are disposed in parallel planes substantially perpendicular to the axis Z. Each series of teeth 88 forms a gear sector, extending about the axis Z. The series of teeth are separated from each other by a recess 94 of the trigger 23. The teeth 88 are situated at the rear end of the trigger in the area of lateral walls of the trigger, and the recess 94 emerges toward the rear between these walls.

The pinion 90 is movable in rotation about an axis V parallel to the axes Y and Z. It comprises two coaxial cylindrical pegs 96 for centering and guiding the pinion in rotation, which are configured to being lodged respectively in seats 96*a* of complementary shape in the shells of the housing (FIG. 2).

The pinion 90 comprises, between the pegs 96, two or three annular rows of teeth. It comprises a first annular row of teeth 100*a* configured to being lodged in the recess 94 of the trigger and able to move freely within this recess. Furthermore, it comprises at least one annular row of teeth 100*b* configured to being intermeshed with the teeth 88 of the trigger 23. These teeth 100*b* can be situated on either side of the teeth 100*a*, the pinion thus comprising two annular rows of teeth 100*b* separated from each other by the teeth 100*a*. As a variant, the teeth 100*b* can extend between the teeth 100*a* and have a width larger than that of the teeth 100*a* so that they protrude on either side from the teeth 100*a* and can intermesh with the teeth 88 of the trigger. As can be seen in FIG. 7, the teeth 100*a* have a radial dimension, relative to the axis V, which is greater than that of the teeth 100*b*.

Figure 8B:
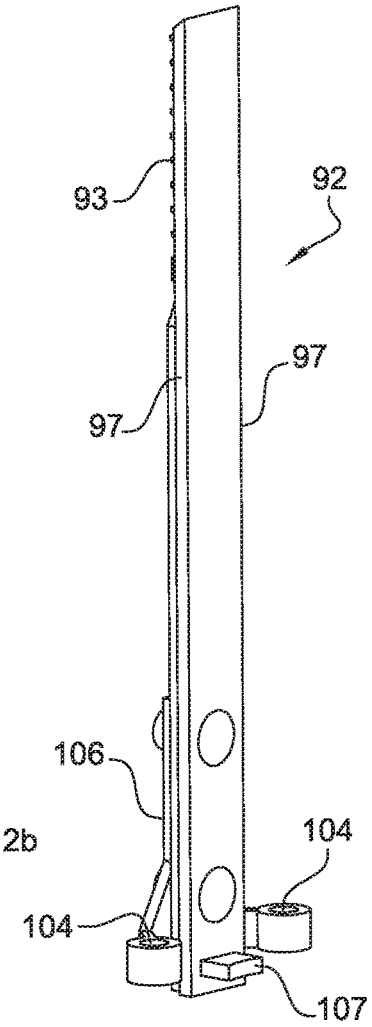

FIGS. 8*a* and 8*b* show the rack 92 and FIGS. 9 and 10 show its integration in the tool 10.

The rack 92 is formed by a longitudinal element such as a ruler, one portion of whose longitudinal end, here the upper one, comprises rack teeth 93. These rack teeth 93 are configured to cooperate with the teeth 100*a* of the pinion 90, as illustrated in FIG. 10. In the example shown, the teeth 93 extend for about 20% to 40% of the length of the longitudinal element from its upper longitudinal end.

The rack 92 here has substantially a T shape in cross section and comprises two coplanar longitudinal lateral flanges 97 which cooperate by sliding with longitudinal flanges 98 having substantially an L cross section of the box 24. The flanges 98 can be formed by a single piece with the box 24. The flanges 98 form a slideway inside which the rack 92 can slide along the longitudinal axis of the box 24 and of the chamber 28.

The rack 92 is guided in translation with respect to the box 24 by the flanges 98. The rack 92 is movable between a first position of rest, the high position here, and a second or low position. It is biased in its first position by an elastic return device, such as compression springs 101 (FIG. 10). These springs 101 are parallel here to the rack 92 and mounted between the lower end of the rack and an element of the tool. The springs 101 can be maintained in position and guided by cylindrical rods 102 fixed to the aforementioned element of the tool and engaging by sliding in corresponding openings 104 of the rack. In the example shown, the openings 104 are defined by an insert 106 secured to the lower end of the rack 92. This part 106 has a general upside-down T shape here, whose middle bar extends along the rack and whose ends of the lateral branches define the openings 104.

The rack 92 comprises at its lower longitudinal end a tongue 107 which is oriented substantially perpendicular to the axis of extension of the rack and on the side with the box 24. The tongue 107 here is formed as a single piece with the T-shaped part. This tongue 107 passes through a slot of the box 24 and can slide into this slot during the movements of the rack 92.

FIGS. 9 and 10 also illustrate the precombustion chamber 28 defined by the box 24. This chamber 28 has a cylindrical shape. It comprises at its lower longitudinal end an admission valve 108, comprising a fixed body 108*a* and a movable body 108*b*, the cooperation of the fixed body with the movable body making it possible to close in a seal-tight manner an orifice 110 for admission of fuel delivered by the device 36. The chamber 28 comprises at its upper longitudinal end an evacuation valve 112, comprising a fixed body (not visible) and a movable body 112*b*, the cooperation of the fixed body with the movable body making it possible to close in a seal-tight manner an orifice (not visible) for evacuation of the combustion gases from the chambers 28, 30. The movable bodies 108*b*, 112*b* of the valves are joined together by a control rod 114 which carries the aforementioned valve 52, at a distance from the movable bodies.

The movable body 112*b* has a piston shape and carries a gasket 116 at its periphery, configured to cooperate with a peripheral edge of the evacuation orifice. The movable body 108*b* has a hollow cylindrical shape and carries a gasket 118 at its periphery, configured to cooperate with a peripheral edge of the chamber 28. The fixed body 108*a* is configured to being engaged with the lower end of the movable body 108*b* and it has a complementary shape, here cylindrical, to the internal bore of the movable body 108*b*. This fixed body 108*a* carries a gasket 120 at its periphery, configured to cooperate with the internal cylindrical surface of the movable body 108*b*. The movable body 108*b* is connected to the lower end of the rod 114 by way of two arms 122 extending upward in the prolongation of the movable body. These arms 122 here are diametrically opposite in relation to the longitudinal axis of the chamber 28 and of the box 24.

The movable body 108*b* of the admission valve 108 comprises an external annular groove 124 in which is engaged the tongue 107 of the rack 92, as can be seen in FIG. 10. It will therefore be understood that the movement in translation of the rack 92 along the box 24 will be manifested as a movement of the movable body 108*b* (as well as the rod 114, the valve 52, and the movable body 112*b*) in the box 24. When the rack 92 is moved downward from its first to its second position, the movable bodies and the valve 52 move downward until such time as the movable bodies 108*b*, 112*b* cooperate with the fixed bodies of the valves for a seal-tight closure of the admission and evacuation orifices, respectively. The valve 52, for its part, will cooperate with an annular seat 124 bounding a fluidic communication orifice between the chambers 28 and 30. This orifice forms an admission orifice for the air-fuel mixture in the chamber 30. When the rack 92 is moved upward, by elastic recall produced by the springs 101, from its second to its first position, the movable bodies and the valve 52 move upward. The admission and evacuation orifices are freed up, as is the fluidic communication orifice between the chambers 28 and 30.

The description of the overall functioning of the tool of the embodiment as described above will now be resumed by referring to FIGS. 11*a* to 14*b*.

FIGS. 11*a* and 11*b* show the tool 10 at rest. The different members and other parts described in the foregoing are in their respective positions of rest or first positions.

FIGS. 12*a* and 12*b* show the tool 10 when one begins to bring it to bear, by way of its bearing member 34, against the support material. The different members and parts as described in the foregoing are in their first positions, except for the bearing member 34 and the actuating member 60, which are in an intermediate position in which the free end of the arm 60*a* of the member 60 bears against the roller 72 or the front end of the member 70, and the roller 68 or end of the arm 60*b* is bearing against the actuating element 50 of the injection device 36. The member 70 is still in its first position of locking of the trigger 23, which cannot be moved into its second position.

Figure 13A:
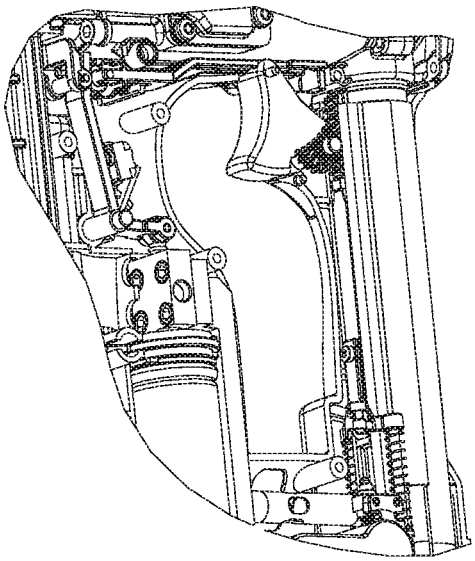
Figure 13B:
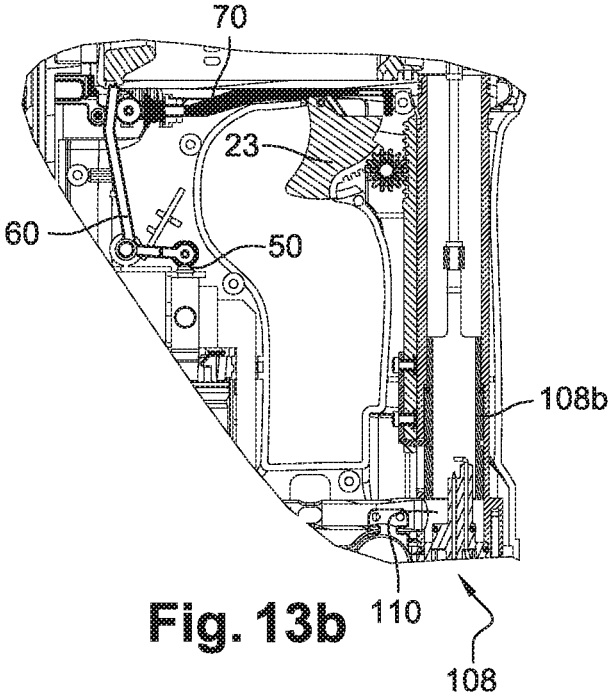
Figure 14A:
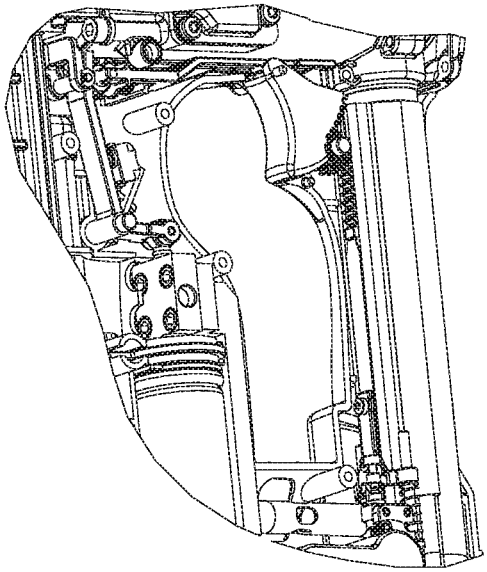
Figure 14B:
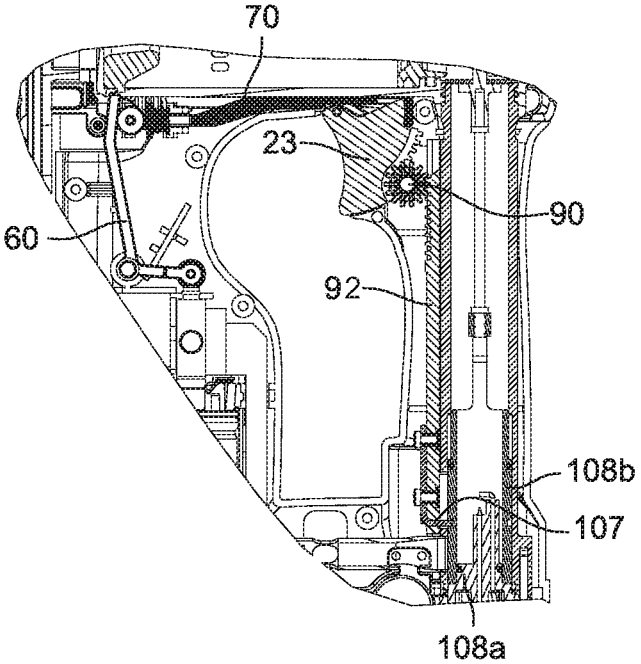

FIGS. 13*a* and 13*b* show the tool 10 after the tool is bearing against the support material, the member 60 having moved through its total travel and being in its second position in which it has moved, on the one hand, the member 70 in translation toward the rear of the tool, and on the other hand the actuating element 50 downward.

The actuating of the element 50 causes the releasing of a predetermined quantity of fuel, which is mixed with air and injected in the precombustion chamber 28 through its admission orifice 110, the valve 108 being opened (the movable body 108*b* being in high position).

The translation of the member 70, and thus of its flange 82, makes it possible to unlock the trigger 23.

FIGS. 13*a* and 13*b* show the tool 10 after actuation of the trigger 23 by the user, the latter having been moved from its first position to its second position. The pivoting of the trigger about its axis (here, upward) produces a rotation of the pinion 90 about its axis (clockwise in the drawings), which in turn produces a translation of the rack 92 (here, downward). The movement of the rack causes a movement of the tongue 107 and is manifested in a downward movement of the movable body 108*b* of the valve, which is closed by cooperation with its fixed body 108*a*. The movement of the rack 92 can furthermore cause the generating of a spark in the precombustion chamber 28, for purposes of the igniting of the air-fuel mixture contained in this chamber.

FIGS. 15*a* to 18*b* show another variant embodiment of the present disclosure, to which the preceding description is applicable, unless otherwise stated below.

The different members and parts of the tool 110 of this variant are similar to those of the tool 10, except for the actuating member 160, the safety member 170, the trigger 123, and the longitudinal element 192, which are described in the following.

The actuating member 160 of the injection device (not shown) is distinguished from that 60 described in the foregoing in that it comprises a third arm 160*c*. This third arm 160*c* extends backward and upward from the middle of the arm 160*a* configured to cooperate (directly or indirectly) with the bearing member (not visible). The arms 160*a*, 160*c* thus substantially form a Y. The free end of the arm 160*c* is in the shape of a fork 161 with two lateral branches, whose upper free ends here are folded back toward the front and/or the free end of the arm 160*a*.

This member 160 is configured here to cooperate by bearing engagement with the actuating element of the injection device, as described above.

Unlike the previous embodiment, the free end of the arm 160*a* is configured to cooperate only (directly or by way of an appropriate mechanism) with the bearing member of the tool. This end is not configured to cooperate with the member 170. It is the free end or fork 161 of the arm 160*c* which is configured to cooperate by bearing or abutment engagement with the member 170.

Figure 15A:
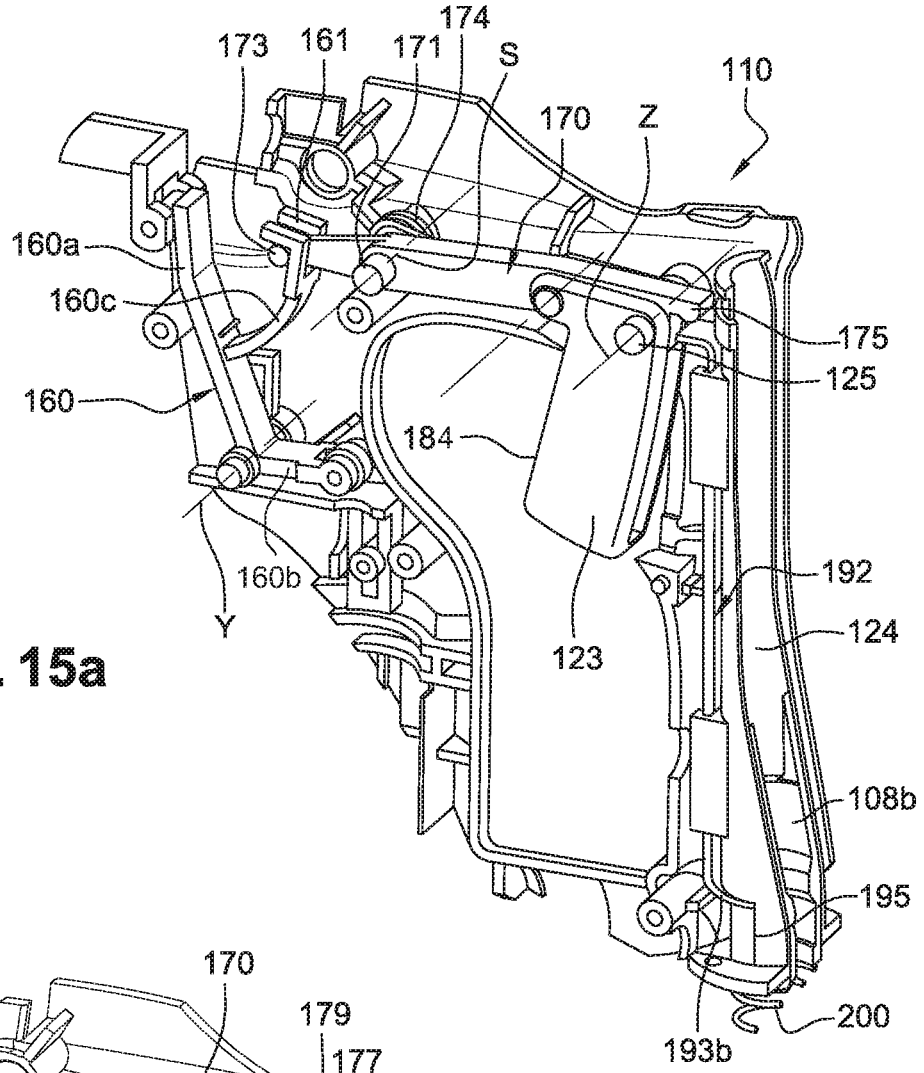
FIGS. 15*a*, 16*a*, 17*a*, and 18*a* are schematic perspective views of internal elements of another embodiment of the tool of the present disclosure.
Figure 15B:
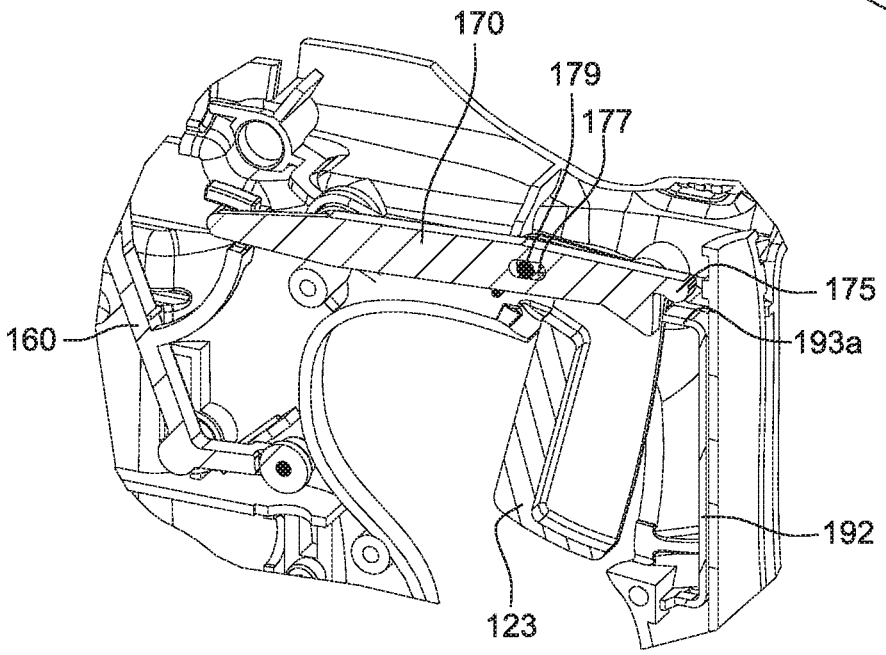
FIGS. 15*b*, 16*b*, 17*b* and 18*b* are schematic cross sectional views of these internal elements, showing the stages of operation of this embodiment of the tool.

The member 160 is movable by pivoting between a first position of rest, shown in FIGS. 15*a* and 15*b* where the arms 160*a*, 160*c*, 160*b* extend respectively and substantially at 11 o'clock, 1 o'clock, and 2 o'clock on the clock dial, to a second position shown in FIGS. 16*a* to 18*b* in which the arms extend respectively at 12 o'clock, 2 o'clock, and 3 o'clock.

The pivoting of the member 160 is caused here by the bearing of the tool 110, and more particularly its bearing member, against the support material. When the tool has not been applied by way of its bearing member against the support material, the member 160 is in its first position. The bearing of the tool against the support material causes the movement of the bearing member with respect to the guide tip, which in turn causes the pivoting of the member 160 from its first to its second position.

The safety member 170, which enables the locking of the trigger 123 in its position of rest, is configured here to cooperate with the actuating member 160, the trigger 123, as well as the longitudinal element 192.

In the example shown, the member 170 has an elongated shape and is mounted pivotably about an axis S substantially parallel to the pivoting axis Y of the member 160. The member 170 comprises two coaxial lateral pegs 171 in the vicinity of its front end, which define the axis S. They are configured to be mounted in rotary manner in seats of complementary shape in the shells of the housing. The portion of the member 170 extending forward from the axis S has a shorter length than that which extends backward from this axis S in the example shown.

The front portion of the member 170 (in front of the pegs 171) extends between the branches of the fork 161 and carries at its front free end a transverse pin 173 (substantially parallel to the axis S), which is able to bear against and cooperate with the branches and their folded-back ends of the fork 161. As can be seen in the drawings, when the member 160 is in its first position, the member 170 is maintained and locked in a first predetermined angular position about the axis S, by the bearing of the pin 173 against the branches and the folded-back ends of the branches. The member 170 is biased in this angular position of rest by an elastic return device, which comprises here a spring 174 mounted about the axis S and bearing respectively against the member 170 and the housing of the tool.

The rear portion of the member 170 (behind the pegs 171) comprises at its rear free end a pin 175 for bearing against the longitudinal element 192. At a distance from the axis S and from this pin 175, the rear portion of the member 170 comprises a transverse slot 177 (in a direction parallel to the axis S), through which passes a physical axle 179 carried by the trigger 123.

The slot 177 has an elongated or oblong shape so that the physical axle 179 is lodged with play in this slot (FIG. 15*b*). This play enables the axle 179 to move, substantially front to rear and rear to front, with regard to the member 170.

Figure 17A:
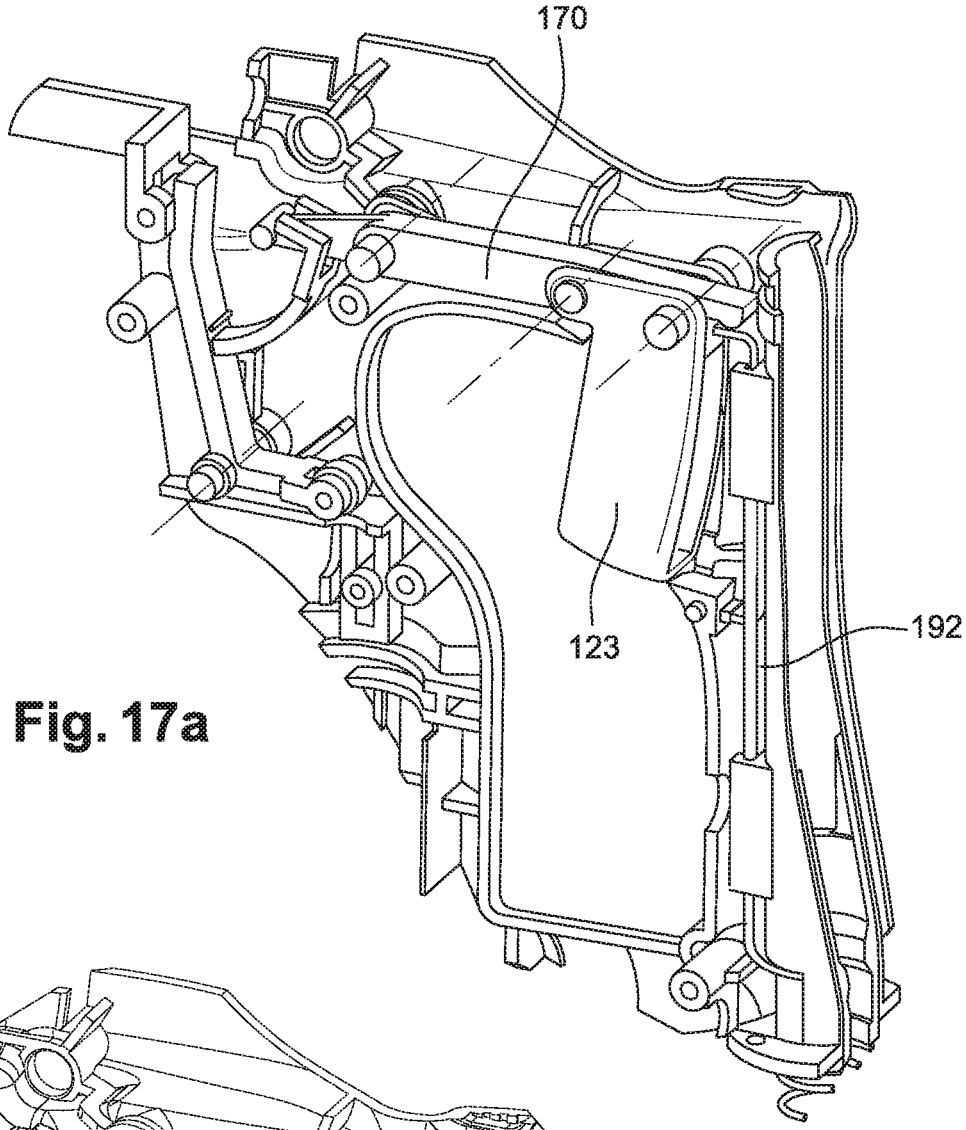
Figure 17B:
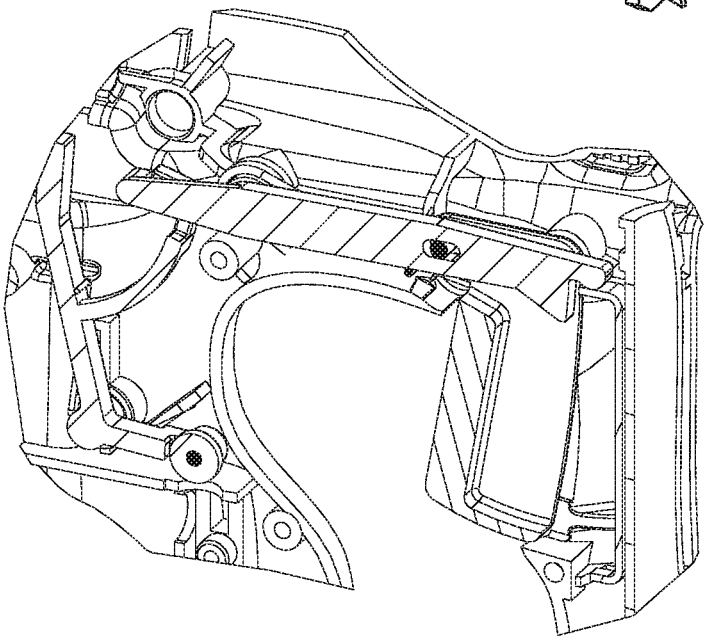
Figure 18A:
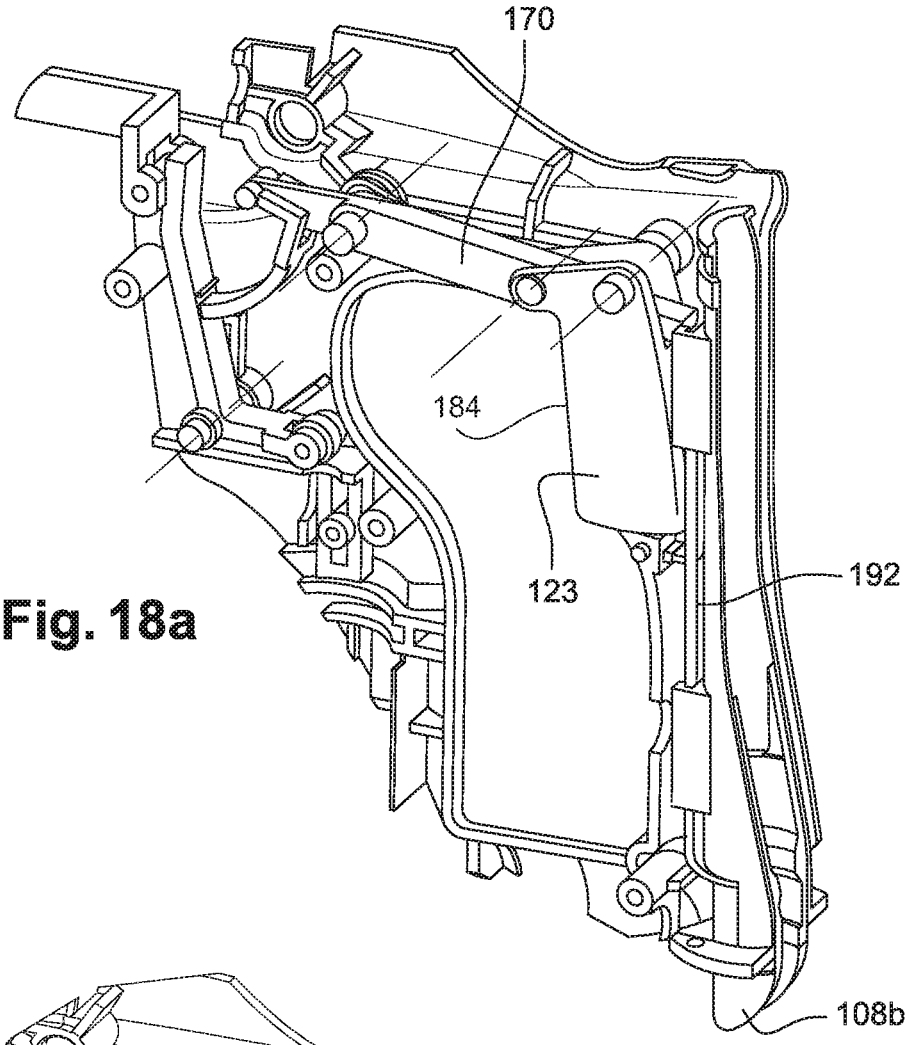
Figure 18B:
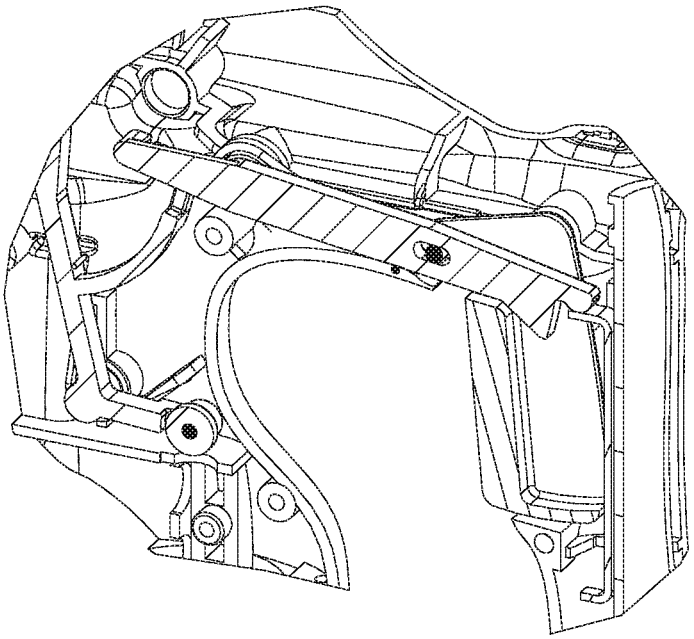

The member 170 is movable by pivoting between its first position of rest shown in FIGS. 15*a* to 16*b* where its front pin 173 is held captive or able to be held captive by the fork 161, and its rear pin 175 is at a distance from the upper end of the longitudinal element 192, to a second position shown in FIGS. 18*a* and 18*b* where its front pin 173 is released from the fork 161, and its rear pin 175 is bearing against the upper end of the longitudinal element 192 and has moved the latter downward. The angular displacement of the member 170 between these two positions is for example less than 10° or 20°. FIGS. 17*a* and 17*b* show an intermediate position of the member 170 in which its front pin 173 is able to be released from the fork 161, and its rear pin 175 is bearing against the upper end of the longitudinal element 192 but has not yet driven the latter downward The movement of the member 170 here is brought about by the actuating of the trigger 123, which is made possible by the releasing of the member 170 by the member 160.

The trigger 123 of the tool 110 is mounted to be pivoting, here, by its upper end, about an axis Z substantially parallel to the axes Y and S. In typical fashion, it comprises a surface 184, here the front surface, for bearing against by at least one finger of the user, such as an index finger.

The trigger 123 likewise comprises at its upper and rear end coaxial lateral cylindrical pegs 125 which are mounted to be rotational in seats of complementary shape in the shells of the housing. The trigger 123 furthermore carries the aforethought axle 179, here at its upper and front end.

When the member 160 is in its position of rest (FIGS. 15*a* and 15*b*), the member 170 as well as the trigger 123 are locked in their positions of rest. If the user tries to operate the trigger 123, he will then feel a resistance corresponding to the bearing of the pin 173 against the fork 161. Thus, the user will not be able to operate the trigger 123. The pivoting of the member 160 from its first to its second position (FIGS. 16*a* and 16*b*) makes it possible to release the member 170 and the trigger 123. In this second position, the fork 161 of the member 160 is disengaged from the pin of the member 170 which is thus free to pivot about its axis S. If the user presses on the trigger 123, he can move it from its first position to an intermediate position shown in FIGS. 17*a* and 17*b* where the member 170 is moved by pivoting until its pin bears against the upper end of the longitudinal element 192. The axes S, Z and 179 are then substantially coplanar in the example shown. The user can then continue pivoting the trigger 123, bringing it into its second position shown in FIGS. 18*a* and 18*b*, where the member 170 has moved by pivoting to its second position and on this occasion has moved downward the longitudinal element 192. During the pivoting of the trigger 123 about the axis Z, the axis 179 moves into the slot 177 of the member 170.

The longitudinal element 192 has the shape of a ruler, one longitudinal end of which, here the upper end, comprises a surface 193*a* for the bearing of the pin 175 of the member 170. This longitudinal element 192 can be formed by a simple metal sheet which has been cut out and bent. The element 192 is mounted to slide on the box 124, along its longitudinal axis, this box being able to have a sliding component, for example, of the slideway type, similar to those described with reference to the preceding embodiment.

The element 192 is movable between a first position of rest, here the high position, and a second or low position. It is biased in its first position by an elastic return device, such as a compression spring 200.

The element 192 comprises at its lower longitudinal end at least one tongue 193*b* which is oriented substantially perpendicular to the axis of extension of the element 192 and on the side with the box 124. This tongue 193*b* passes through a slot 195 of the box 124 and can slide into this slot during the movements of the element 192. It is engaged in a groove or recess of the movable body 108*b* of the admission valve for purposes of the movement of this body inside the precombustion chamber and the opening and closing of the admission orifice of this chamber. In the example shown, the spring 200 biases the longitudinal element 192 in its position of rest by bearing against the movable body 108*b*.

FIGS. 15*a* and 18*b* illustrate the operation of the tool 110.

FIGS. 15*a* and 15*b* show the tool 110 at rest. The different members and other parts described in the foregoing are in their respective positions of rest or first positions.

Figure 16A:
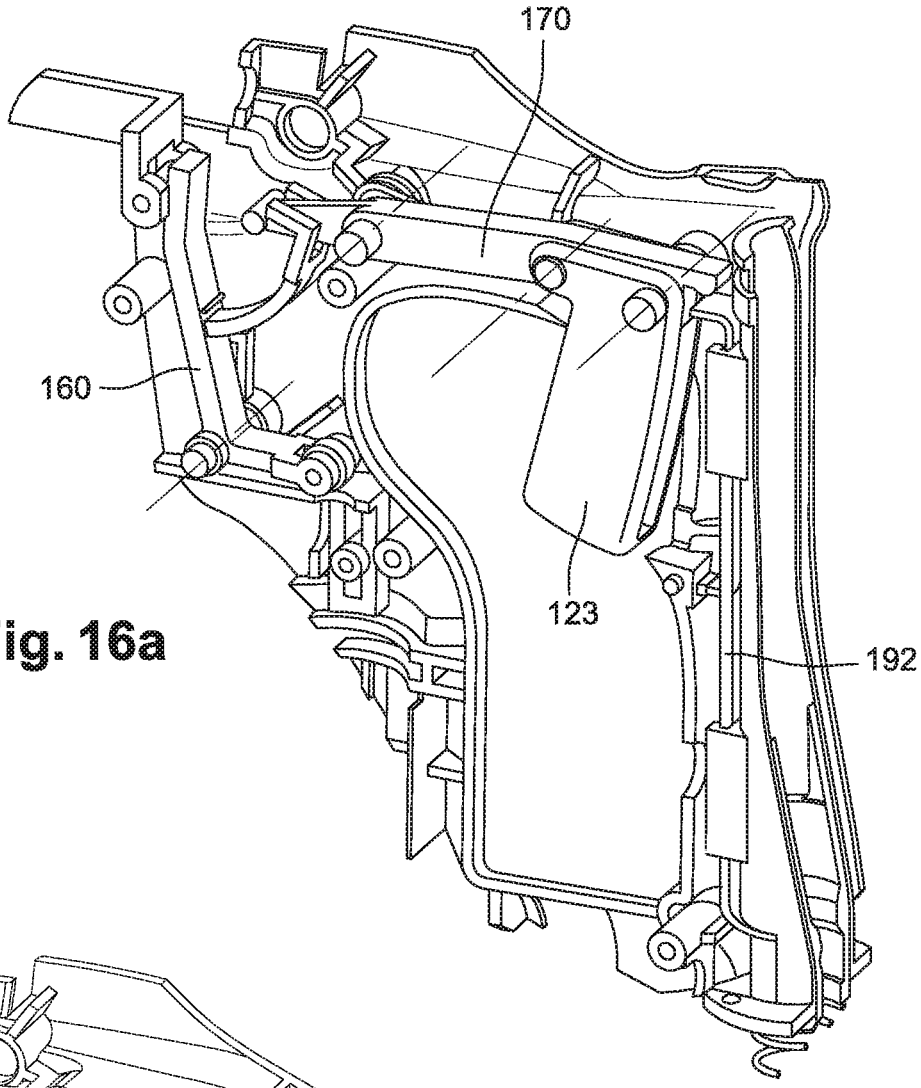
Figure 16B:
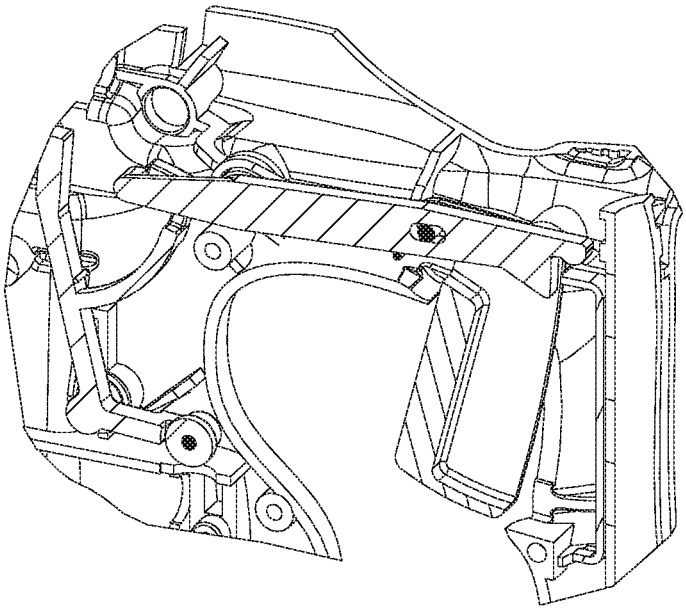

FIGS. 16*a* and 16*b* show the tool 10 when it is brought to bear against the support material. The member 160 is in its second position of unlocking of the member 170.

FIGS. 17*a* and 17*b* show the tool 110 when the user has begun to press on the trigger 123 and FIGS. 18*a* and 18*b* show the tool 110 at the end of the actuating of the trigger 123. The actuating of the trigger causes a pivoting of the member 170 about its axis S, and a downward movement of the longitudinal element 192 which pulls along with it the movable body 108*b* of the admission valve, as explained previously.

Figure 19A:
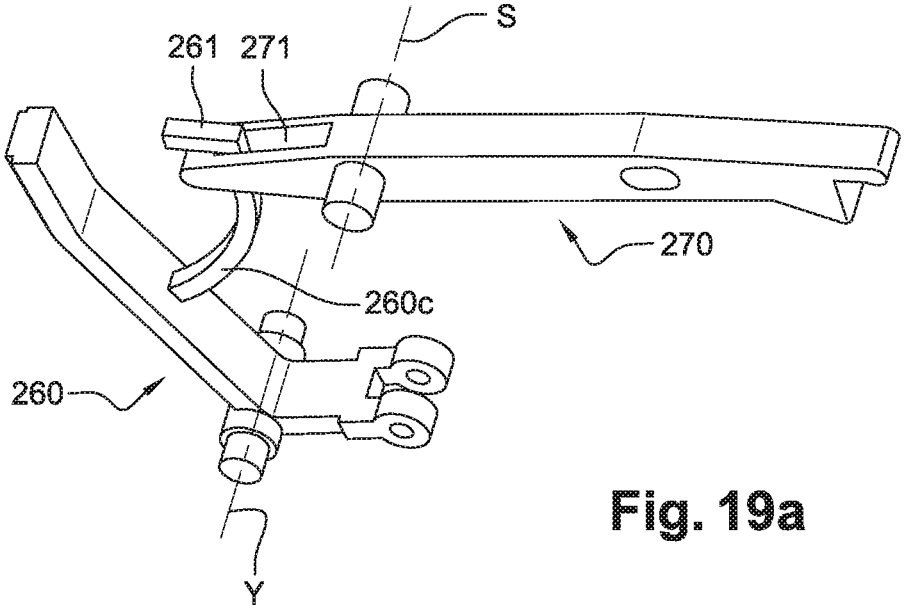
FIGS. 19*a* and 19*b* are schematic perspective views of an actuating member and of a safety member according to another embodiment of the tool of the present disclosure.
Figure 19B:
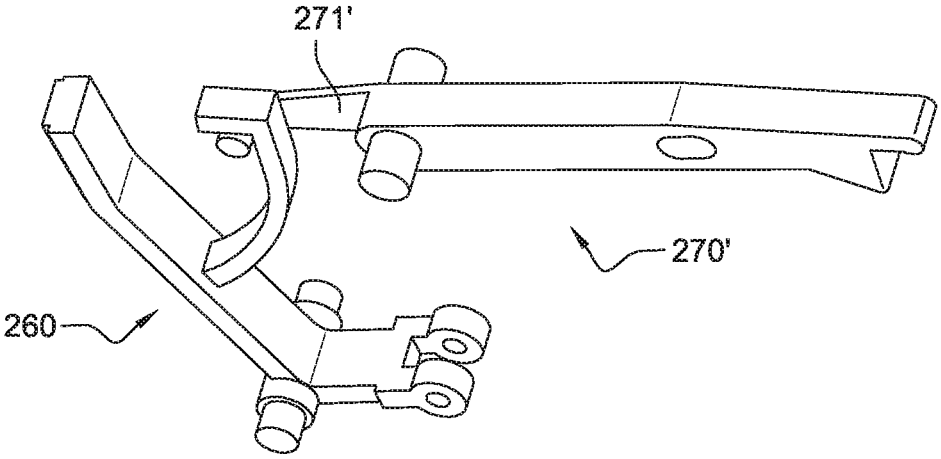

FIGS. 19*a* and 19*b* show variant embodiments of the actuating and safety members.

The actuating and safety members of these figures are similar to those of FIGS. 15*a* to 18*b*. The actuating member 260 of FIG. 19*a* is distinguished from that 160 of FIGS. 15*a* to 18*b* in that its fork has been replaced by a simple L-shaped branch 261. The safety member 270 of FIG. 19*a* is distinguished from that 170 of FIGS. 15*a* to 18*b* in that its front portion does not have a pin, but instead a traversing slot 271 (in a direction perpendicular to the axis S), and in which is mounted in sliding manner the branch of the member 260 (sliding in a plane perpendicular to the axes S and Y). The pivoting movements of the members 260 and 270 are similar to those described in regard to the previous embodiment. The slot of the member 270 here has a length greater than that of the folded-back part of the branch 261 of the member 260, so that the arm 260*c* of the member 260 can be completely removed from the slot 271 when the member 270 pivots between its first and its second position.

The actuating member 260 of FIG. 19*b* is similar to that of FIG. 19*a*. The safety member 270' is distinguished from that of the preceding figure in that its slot is replaced by a lateral notch 271'. The cooperation of the members 260 and 270' is similar to that of the members 260 and 270.

Various modifications to the above-described embodiments will be apparent to those skilled in the art. These modifications can be made without departing from the spirit and scope of this present subject matter and without diminishing its intended advantages. Not all of the depicted components described in this disclosure may be required, and some implementations may include additional, different, or fewer components as compared to those described herein. Variations in the arrangement and type of the components; the shapes, sizes, and materials of the components; and the manners of attachment and connections of the components may be made without departing from the spirit or scope of the claims set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A fastener-driving tool comprising:

a housing;

a combustion chamber at least partially within the housing;

a trigger pivotable about a first axis relative to the housing between a rest position and a firing position, wherein the trigger includes:

an upper end; and a surface engageable by a finger of a user, the surface positioned opposite the upper end;

a fuel injection device in fluid communication with the combustion chamber and actuatable to dispense fuel into the combustion chamber;

an actuating member pivotable relative to the housing from a non-actuating position to an actuating position to actuate the fuel injection device;

a bearing member movable from a first position to a second position, the bearing member operably connected to the actuating member to move the actuating member from the non-actuating position to the actuating position when moving from the first position to the second position; and a safety member movable laterally along a second axis transverse to the first axis, the safety member positioned to prevent the trigger from pivoting from the rest position to the firing position when the actuating member is in the non-actuating position, wherein the safety member is engageable with the upper end of the trigger.

2. The tool of claim 1, wherein the safety member is movable relative to the housing between a lock position and an unlock position, and wherein when in the lock position the safety member prevents the trigger from moving from the rest position to the firing position.

3. The tool of claim 2, wherein the safety member is in the lock position when the actuating member is in the non-actuating position, wherein the safety member is in the unlock position when the actuating member is in the actuating position.

4. The tool of claim 2, wherein the actuating member is operatively connectable to the safety member to move the safety member from the lock position to the unlock position when moving from the non-actuating position to the actuating position.

5. The tool of claim 4, wherein the actuating member is positioned to contact the safety member to move the safety member from the lock position to the unlock position when moving from the non-actuating position to the actuating position.

6. The tool of claim 2, wherein the trigger is operatively connected to the safety member to move the safety member from the lock position to the unlock position when moving from the rest position to the firing position.

7. The tool of claim 6, wherein the trigger is pivotably connected to the safety member.

8. The tool of claim 2, wherein the safety member is translatable relative to the housing to move between the lock position and the unlock position.

9. The tool of claim 2, which includes a biasing element that biases the safety member to the lock position.

10. The tool of claim 1, which includes an ignition device, wherein one of: (1) the trigger is operably connected to the ignition device to activate the ignition device upon movement from the rest position to the firing position; and (2) the safety mechanism is operably connectable to the ignition device to activate the ignition device upon movement from the lock position to the unlock position.

11. The tool of claim 1, which includes a chamber closing mechanism movable relative to the housing from an open position to a closed position to close the combustion chamber.

12. The tool of claim 11, wherein the safety member is movable relative to the housing between a lock position and an unlock position, and wherein the safety member is operably connectable to the chamber closing mechanism to move the chamber closing mechanism from the open position to the closed position when moving from the lock position to the unlock position.

13. The tool of claim 11, wherein the trigger is operably connected to the chamber closing mechanism to move the chamber closing mechanism from the open position to the closed position when moving from the rest position to the firing position.

14. The tool of claim 13, wherein the trigger is operably connected to the chamber closing mechanism via a pinion gear that operably engages a rack of the chamber closing mechanism.

15. A fastener-driving tool comprising:

a trigger movable between a rest position and a firing position, the trigger including:
an upper end; and
a surface engageable by a finger of a user, the surface positioned opposite the upper end;

a fuel injection device actuatable to dispense fuel;

an actuating member movable from a non-actuating position to an actuating position to actuate the fuel injection device;

a bearing member operably connected to the actuating member to move the actuating member from the non-actuating position to the actuating position; and a safety member engageable with the upper end of the trigger, the safety member movable between a lock position and an unlock position, wherein when in the lock position the safety member prevents the trigger from moving from the rest position to the firing position, wherein the actuating member is operatively connectable to the safety member to move the safety member from the lock position to the unlock position, and wherein the actuating member is positioned to contact the safety member to move the safety member from the lock position to the unlock position when moving from the non-actuating position to the actuating position.

16. The tool of claim 15, wherein the bearing member is movable between a first position and a second position and is operably connected to the actuating member such that movement from the first position to the second position causes the actuating member to move from the non-actuating position to the actuating position.

17. The tool of claim 16, wherein the actuating member is operatively connectable to the safety member to move the safety member from the lock position to the unlock position when moving from the non-actuating position to the actuating position.

18. A fastener-driving tool comprising:

a trigger movable between a rest position and a firing position;

a fuel injection device actuatable to dispense fuel;

an actuating member pivotable from a non-actuating position to an actuating position to actuate the fuel injection device;

a bearing member operably connected to the actuating member to move the actuating member from the non-actuating position to the actuating position; and a safety member pivotably connected to the trigger and movable between a lock position and an unlock position, wherein when the actuating member is in the non-actuating position and the safety member is in the lock position, the safety member prevents the trigger from moving from the rest position to the firing position, and wherein the trigger is operatively connected to the safety member such that, when the actuating member is in the actuating position, movement of the trigger from the rest position to the firing position causes the safety member to move from the lock position to the unlock position.

19. A fastener-driving tool comprising:

a housing;

a combustion chamber at least partially within the housing;

a trigger pivotable about a first axis relative to the housing between a rest position and a firing position;

a fuel injection device in fluid communication with the combustion chamber and actuatable to dispense fuel into the combustion chamber;

an actuating member pivotable relative to the housing from a non-actuating position to an actuating position to actuate the fuel injection device;

a bearing member movable from a first position to a second position, the bearing member operably connected to the actuating member to move the actuating member from the non-actuating position to the actuating position when moving from the first position to the second position; and a safety member movable laterally along a second axis transverse to the first axis, the safety member positioned to prevent the trigger from pivoting from the rest position to the firing position when the actuating member is in the non-actuating position, wherein the safety member is movable relative to the housing between a lock position and an unlock position, and wherein when in the lock position the safety member prevents the trigger from moving from the rest position to the firing position, wherein the actuating member is operatively connectable to the safety member to move the safety member from the lock position to the unlock position when moving from the non-actuating position to the actuating position, and wherein the actuating member is positioned to contact the safety member to move the safety member from the lock position to the unlock position when moving from the non-actuating position to the actuating position.

20. A fastener-driving tool comprising:

a housing;

a combustion chamber at least partially within the housing;

a trigger pivotable about a first axis relative to the housing between a rest position and a firing position;

a fuel injection device in fluid communication with the combustion chamber and actuatable to dispense fuel into the combustion chamber;

an actuating member pivotable relative to the housing from a non-actuating position to an actuating position to actuate the fuel injection device;

a bearing member movable from a first position to a second position, the bearing member operably connected to the actuating member to move the actuating member from the non-actuating position to the actuating position when moving from the first position to the second position; and a safety member movable laterally along a second axis transverse to the first axis, the safety member positioned to prevent the trigger from pivoting from the rest position to the firing position when the actuating member is in the non-actuating position, wherein the safety member is movable relative to the housing between a lock position and an unlock position, and wherein when in the lock position the safety member prevents the trigger from moving from the rest position to the firing position, and wherein the trigger is operatively connected to the safety member to move the safety member from the lock position to the unlock position when moving from the rest position to the firing position.

21. A fastener-driving tool comprising:

a housing;

a combustion chamber at least partially within the housing;

a trigger pivotable about a first axis relative to the housing between a rest position and a firing position;

a fuel injection device in fluid communication with the combustion chamber and actuatable to dispense fuel into the combustion chamber;

an actuating member pivotable relative to the housing from a non-actuating position to an actuating position to actuate the fuel injection device;

a bearing member movable from a first position to a second position, the bearing member operably connected to the actuating member to move the actuating member from the non-actuating position to the actuating position when moving from the first position to the second position;

a safety member movable laterally along a second axis transverse to the first axis, the safety member positioned to prevent the trigger from pivoting from the rest position to the firing position when the actuating member is in the non-actuating position; and a chamber closing mechanism movable relative to the housing from an open position to a closed position to close the combustion chamber, wherein the safety member is movable relative to the housing between a lock position and an unlock position, and wherein the safety member is operably connectable to the chamber closing mechanism to move the chamber closing mechanism from the open position to the closed position when moving from the lock position to the unlock position.

22. A fastener-driving tool comprising:

a housing;

a combustion chamber at least partially within the housing;

a trigger pivotable about a first axis relative to the housing between a rest position and a firing position;

a fuel injection device in fluid communication with the combustion chamber and actuatable to dispense fuel into the combustion chamber;

an actuating member pivotable relative to the housing from a non-actuating position to an actuating position to actuate the fuel injection device;

a bearing member movable from a first position to a second position, the bearing member operably connected to the actuating member to move the actuating member from the non-actuating position to the actuating position when moving from the first position to the second position;

a safety member movable laterally along a second axis transverse to the first axis, the safety member positioned to prevent the trigger from pivoting from the rest position to the firing position when the actuating member is in the non-actuating position; and a chamber closing mechanism movable relative to the housing from an open position to a closed position to close the combustion chamber, wherein the trigger is operably connected to the chamber closing mechanism to move the chamber closing mechanism from the open position to the closed position when moving from the rest position to the firing position.

* * * * *